US009086676B2

(12) United States Patent
Nakamura et al.

(10) Patent No.: US 9,086,676 B2
(45) Date of Patent: Jul. 21, 2015

(54) DEVELOPING CARTRIDGE AND ELECTROPHOTOGRAPHIC IMAGE FORMING APPARATUS

(75) Inventors: Yuuki Nakamura, Mishima (JP); Tetsuya Numata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 68 days.

(21) Appl. No.: 13/587,617

(22) Filed: Aug. 16, 2012

(65) Prior Publication Data

US 2013/0051810 A1 Feb. 28, 2013

(30) Foreign Application Priority Data

Aug. 30, 2011 (JP) ..... 2011-187330

(51) Int. Cl.
*G03G 15/01* (2006.01)
*G03G 15/08* (2006.01)
*G03G 21/16* (2006.01)

(52) U.S. Cl.
CPC ..... *G03G 21/1647* (2013.01); *G03G 15/0126* (2013.01); *G03G 15/0863* (2013.01); *G03G 21/1676* (2013.01)

(58) Field of Classification Search
CPC ..... G03G 15/0863; G03G 21/1647; G03G 21/1676; G03G 15/01; G03G 21/1842; G03G 21/1864; G03G 21/1871; G03G 2215/1603; G03G 2215/163; G03G 2221/183
USPC ..... 399/12, 13, 110, 111, 112, 119, 223
See application file for complete search history.

(56) References Cited

U.S. PATENT DOCUMENTS 7,463,835 B2 * 12/2008 Harumoto ..... 399/12
2012/0093523 A1 * 4/2012 Kamoshida et al. ..... 399/12

FOREIGN PATENT DOCUMENTS

JP 2003-084534 A 3/2003

* cited by examiner

*Primary Examiner* — Sophia S Chen
(74) *Attorney, Agent, or Firm* — Canon USA Inc IP Division

(57) ABSTRACT

There is provided a developing cartridge that prevents forced erroneous mounting of the developing cartridge by a user and capable of easily recognizing the erroneous mounting by the user, and an electrophotographic image forming apparatus. When an erroneous mounting is performed, the developing cartridge is returned to a mounting start side from the vicinity of a mounting end position. Therefore, the user can easily recognize the erroneous mounting. By using a pressure member for urging the developing cartridge to an image carrier for detection of the erroneous mounting, deformation or damage of a main assembly or the developing cartridge can be suppressed.

17 Claims, 33 Drawing Sheets

DEVELOPING CARTRIDGE AND ELECTROPHOTOGRAPHIC IMAGE FORMING APPARATUS

BACKGROUND OF THE INVENTION

1. Field of the Invention

The present invention relates to a developing cartridge that develops an electrostatic latent image formed on an image carrier, and an electrophotographic image forming apparatus to which the developing cartridge is detachably mountable.

A developing cartridge is formed by integrating, as a cartridge, a development member that develops an electrostatic latent image formed on an image carrier such as an electrophotographic photosensitive member, and a toner containing unit that contains a toner, and is detachably mountable to a main assembly of an electrophotographic image forming apparatus.

The electrophotographic image forming apparatus forms an image on a recording medium by using an electrophotographic image forming process. The electrophotographic image forming apparatus includes an electrophotographic copying machine, an electrophotographic printer (a light-emitting diode (LED) printer or a laser beam printer), an electrophotographic facsimile apparatus, and an electrophotographic word processor.

2. Description of the Related Art

A conventional image forming apparatus includes an in-line type electrophotographic image forming apparatus including a plurality of process cartridges arranged in a line having at least one or more process units necessary for image formation. The plurality of process cartridges used for such an electrophotographic image forming apparatus needs to be mounted to predetermined positions of a main assembly of the electrophotographic image forming apparatus. Therefore, each process cartridge has a configuration that cannot be mounted to a position other than a predetermined position of the apparatus.

Similarly, in a single-color electrophotographic image forming apparatus using one process cartridge, only the process cartridge corresponding to a specification or a format of a main assembly can be mounted, and a process cartridge with a different function cannot be mounted.

Many conventional configurations are discussed that suppress erroneous mounting of a process cartridge to an erroneous position. For example, Japanese Patent Application Laid-Open No. 2003-084534 discusses a method for providing an uneven shape such as a mounting key at a position for mounting a process cartridge to an electrophotographic image forming apparatus, and changing a position of the mounting key depending on a color of a contained developer.

However, with the conventional technique, even if the process cartridge is erroneously mounted, the intensity needs to be secured in order to prevent deformation or damage of the process cartridge and the main assembly.

SUMMARY OF THE INVENTION

The present invention directed to a developing cartridge and an image forming apparatus capable of easily recognizing erroneous mounting by using a pressure member that urges the developing cartridge to an image carrier and suppressing the deformation or damage of the main assembly and the cartridge.

According to an aspect of the present invention, an electrophotographic image forming apparatus to which a plurality of developing cartridges are detachably mountable, each of the developing cartridges including a developer carrier that develops a latent image formed on an image carrier, a developer container that contains a developer for developing the latent image, and a unique identification portion includes a plurality of mounting portions configured to detachably mount the plurality of the developing cartridges, and a pressure member movably arranged to the mounting portion, configured to contact the identification portion and urge the developing cartridge in an urging direction to the image carrier when the developing cartridge to be mounted to the mounting portion is inserted into the mounting portion, and to contact the identification portion and urge a developing cartridge with a different function in an opposite direction of a mounting direction to the mounting portion when the developing cartridge with the different function is inserted into the mounting portion.

According to another aspect of the present invention, an electrophotographic image forming apparatus to which a plurality of developing cartridges are detachably mountable, each of the developing cartridges including a developer carrier that develops a latent image formed on an image carrier, a developer container that contains a developer for developing the latent image, and a unique identification portion, includes a plurality of mounting portions configured to detachably mount the plurality of developing cartridges, and a pressure member movably arranged corresponding to each of the plurality of the mounting portions, configured to contact the identification portion and urge the developing cartridge in an urging direction to the image carrier in a case where a proper developing cartridge is mounted to the mounting portion when mounting the developing cartridge, and to contact the identification portion and urge the developing cartridge in an opposite direction of the mounting direction of mounting the developing cartridge to the mounting portion in a case where an improper developing cartridge is mounted to the mounting portion.

According to another aspect of the present invention, a developing cartridge detachably mountable to a main assembly of an electrophotographic image forming apparatus including a plurality of mounting portions to which the developing cartridge is detachably mounted, and a pressure member that is movably arranged to each of the mounting portions, includes a developer carrier configured to develop a latent image formed on an image carrier, a developer container configured to contain a developer for developing the latent image, and an identification portion configured to contact the pressure member and receive urging force in a direction of urging the developing cartridge to the image carrier from the pressure member when the developing cartridge is inserted into the main assembly, and receive urging force in an opposite direction of a mounting direction of mounting the developing cartridge to the mounting portion arranged in an electrophotographic image forming apparatus with a function different from that of the electrophotographic image forming apparatus from a pressure member arranged to the electrophotographic image forming apparatus with the different function when the developing cartridge is mounted to the electrophotographic image forming apparatus with the different function.

According to another aspect of the present invention, a developing cartridge detachably mountable to a main assembly of an electrophotographic image forming apparatus including a plurality of mounting portions to which a plurality of the developing cartridges are detachably mounted, and a pressure member that is movably arranged corresponding to each of the plurality of the mounting portions, includes a developer carrier configured to develop a latent image formed on an image carrier, a developer container configured to contain a developer for developing the latent image, and an identification portion configured to contact the pressure member when the developing cartridge is inserted into the main assembly, receive urging force in a direction of urging the developing cartridge to the image carrier from the pressure member in a case of mounting the developing cartridge to a correct mounting portion, and receive urging force in an opposite direction of a mounting direction of mounting the developing cartridge to the mounting portion from the pressure member in a case of mounting the developing cartridge to an incorrect mounting portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
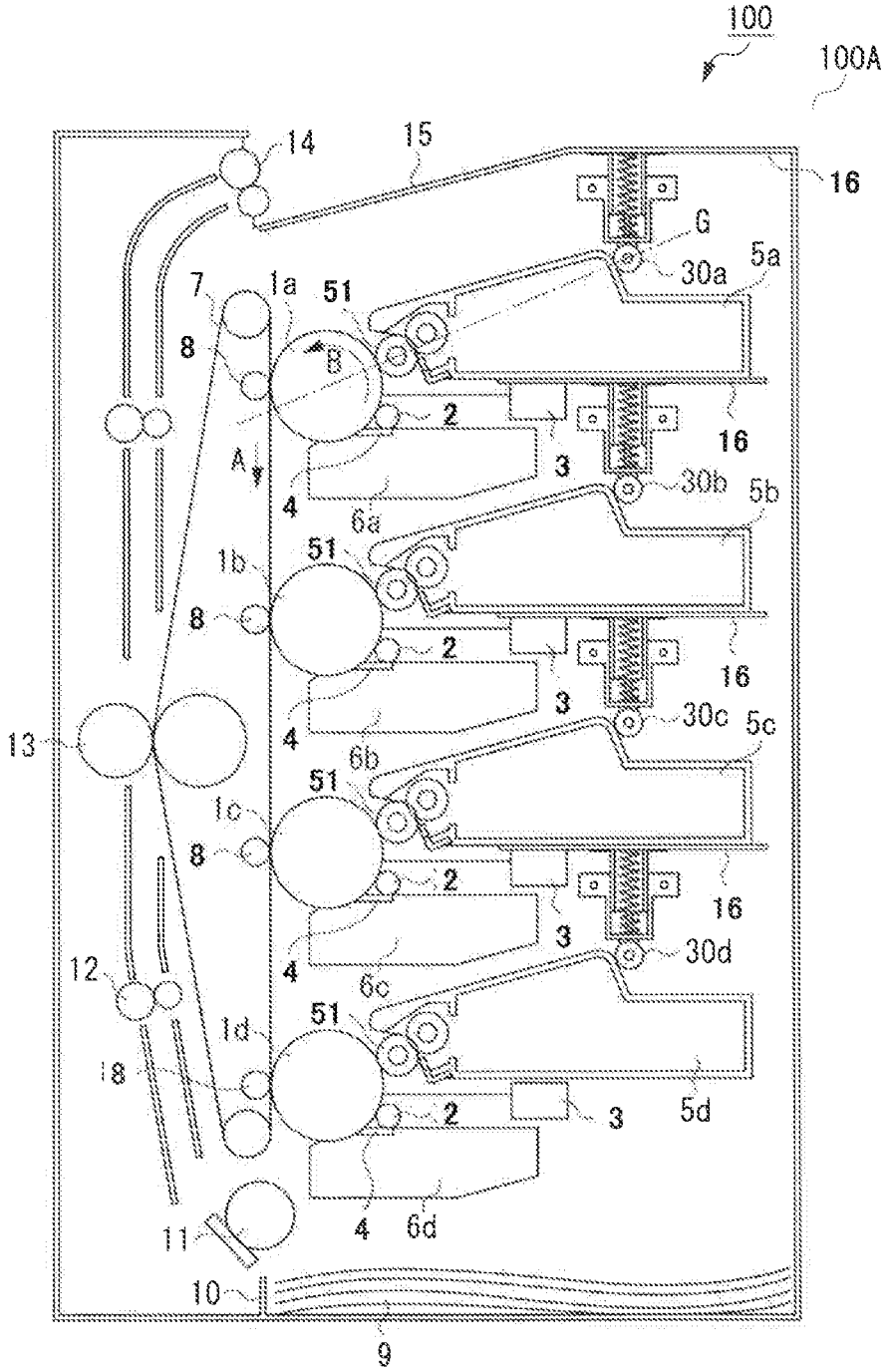
FIG. 1 is a schematic cross-sectional view illustrating an image forming main assembly.

First, an image forming operation of a color electrophotographic image forming apparatus is described with reference to FIG. 1. According to an exemplary embodiment of the present invention, the color electrophotographic image forming apparatus (hereinafter, referred to as an image forming apparatus) is a laser beam printer with four full colors. FIG. 1 is a schematic cross-sectional view illustrating an example of an image forming main assembly according to the present exemplary embodiment.

Referring to FIG. 1, a yellow developing cartridge 5*a*, a magenta developing cartridge 5*b*, a cyan developing cartridge 5*c*, and a black developing cartridge 5*d* are detachably mounted to a main assembly of an image forming apparatus 100. Each of the developing cartridges 5*a* to 5*d* contains a corresponding color toner. Since image formation units of toner developers of corresponding colors to the yellow developing cartridge 5*a*, the magenta developing cartridge 5*b*, the cyan developing cartridge 5*c*, and the black developing cartridge 5*d* are similar, the following description is given by using the yellow developing cartridge 5*a*.

Referring to FIG. 1, the image forming apparatus 100 includes photosensitive drums 1*a*, 1*b*, 1*c*, and 1*d* as image carriers. A plurality of drum cartridges 6*a* to 6*d* is detachably mountable to a main assembly 100A of the image forming apparatus 100. Since configurations of the drum cartridges 6*a* to 6*d* are similar, the following description is given by using the drum cartridge 6*a*.

Referring to FIG. 1, a charge unit 2, an exposure unit 3, the yellow developing cartridge 5*a*, and a cleaning unit 4 are arranged around a photosensitive drum 1*a*. The charge unit 2 evenly charges the photosensitive drum 1*a*. The exposure unit 3 irradiates the photosensitive drum 1*a* with a laser beam, and then forms a latent image thereon. The yellow developing cartridge 5*a* develops the latent image formed on the photosensitive drum 1*a* with a corresponding color toner.

The cleaning unit 4 removes the remaining toner on the photosensitive drum 1*a*. In the present exemplary embodiment, the photosensitive drum 1*a*, the charge unit 2, and the cleaning unit 4 are integrally configured. However, the photosensitive drum 1*a*, the charge unit 2, and the cleaning unit 4 may be separately configured.

The photosensitive drum 1*a* is rotated in a direction of an arrow B in FIG. 1, synchronously with a direction of an arrow A in FIG. 1 as a rotational direction of an intermediate transfer belt 7. In the main assembly 100A of the image forming apparatus 100, the charge unit 2 evenly charges the surface of the photosensitive drum 1*a*, and the exposure unit 3 irradiates a yellow image with light and forms a yellow electrostatic latent image on the photosensitive drum 1*a*. A potential difference is set between the photosensitive drum 1*a* and a developing roller 51 as a developer carrier to adhere a yellow developer to the latent image formed on the photosensitive drum 1*a*.

In this way, the yellow developer is adhered to the latent image formed on the photosensitive drum 1*a*, and the image is developed. That is, a yellow developer image is formed on the photosensitive drum 1*a*. At this time, in order to contact the developing roller 51 stably with the photosensitive drum 1*a*, the yellow developing cartridge 5*a* is urged to the photosensitive drum 1*a* by a pressure member 30*a* provided on the main assembly 100A of the image forming apparatus 100.

Thereafter, a voltage with the opposite polarity of the toner is applied to a primary transfer roller 8 arranged inside of the intermediate transfer belt 7. The yellow toner image of the photosensitive drum 1*a* is primarily transferred to the intermediate transfer belt 7. Similar to the case of yellow, for the magenta, the cyan, and the black, the formation of the electrostatic latent image, the development, and the primary transfer are sequentially performed. Then, four color toner images are overlapped on the intermediate transfer belt 7.

A sheet 9 as a member to which the toner image is transferred, is stacked and stored in a sheet cassette 10 arranged at a lower portion of the image forming apparatus 100, is separated from another sheets and fed from the sheet cassette 10 with a feed roller 11, and is fed to a registration roller pair 12. The registration roller pair 12 conveys the fed sheet 9 to a position between the intermediate transfer belt 7 and a secondary transfer roller 13.

Further, a voltage with the opposite polarity of that of the toner is applied to the secondary transfer roller 13. The four color toner images overlapped on the intermediate transfer belt 7 are secondarily transferred to the surface of the conveyed sheet 9.

The sheet 9 onto which the toner is transferred is fed to a fixing device 14. In the fixing device 14, the sheet 9 is heated and pressed, and the toner images are fixed onto the sheet 9. As a consequence, the image is formed on the sheet 9. Thereafter, the sheet 9 is discharged from the fixing device 14 to a sheet discharge unit of a top cover 15 outside the image forming apparatus 100.

Since configurations of the yellow developing cartridge 5*a*, the magenta developing cartridge 5*b*, the cyan developing cartridge 5*c*, and the black developing cartridge 5*d* are similar, a developing cartridge 5 is used for the description of the configurations of the yellow developing cartridge 5*a*, the magenta developing cartridge 5*b*, the cyan developing cartridge 5*c*, and the black developing cartridge 5*d* according to the present exemplary embodiment.

Since the configurations of the photosensitive drums 1*a*, 1*b*, 1*c*, and 1*d* on which the toner images are formed by the yellow developing cartridge 5*a*, the magenta developing cartridge 5*b*, the cyan developing cartridge 5*c*, and the black developing cartridge 5*d* are similar, a photosensitive drum 1 is used for the description of the photosensitive drums 1*a* to 1*d* according to the present exemplary embodiment.

Figure 2:
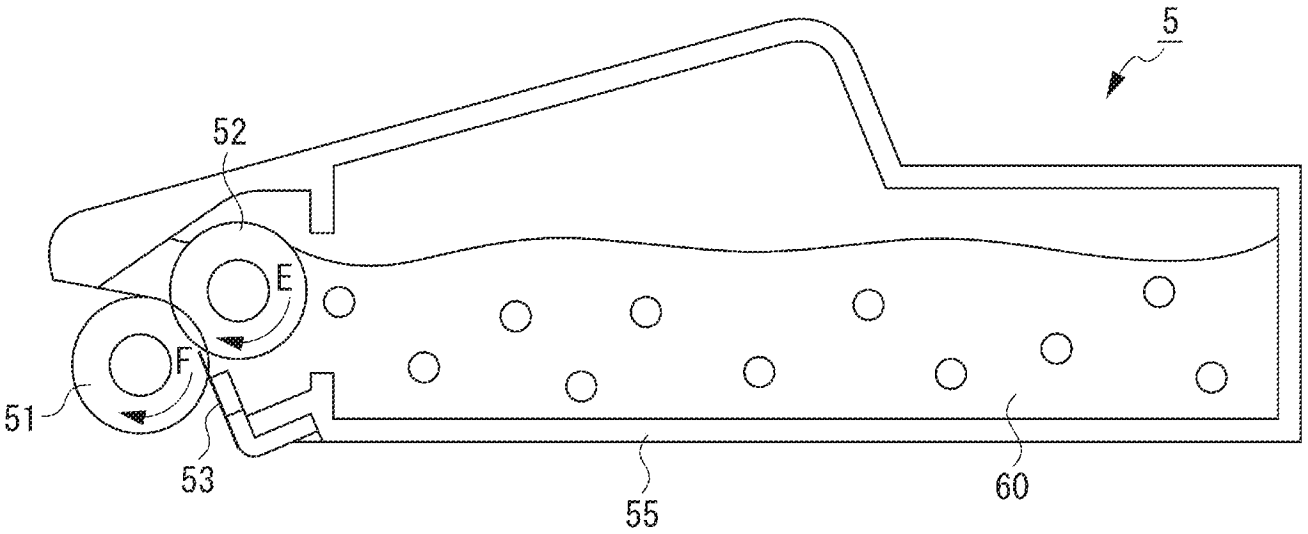
FIG. 2 is a schematic cross-sectional view illustrating a developing cartridge.

The developing cartridge 5 is described with reference to FIG. 2. FIG. 2 is a schematic cross-sectional view illustrating the developing cartridge 5 according to the present exemplary embodiment.

Referring to FIG. 2, the developing cartridge 5 contains a toner 60 in a developer container 55. The toner 60 is supplied to a toner supply roller 52. The toner supply roller 52 is rotated in a direction of an arrow E, thereby supplying the toner 60 to a developing roller 51. The developing roller 51 includes an elastic rubber roller, and is rotated in a direction of an arrow F. The toner 60 on the developing roller 51 is regulated to have a certain thickness by a developing blade 53, and is developed at a developing position on the photosensitive drum 1.

After the development, the toner supply roller 52 removes the remaining toner 60 on the developing roller 51. Then, the toner supply roller 52 supplies toner to the developing roller 51 again.

Since the pressure mechanisms of the yellow developing cartridge 5*a*, the magenta developing cartridge 5*b*, the cyan developing cartridge 5*c*, and the black developing cartridge 5*d* to the photosensitive drum 1 are similar, the developing cartridge 5 is used for the description of the configurations of the yellow developing cartridge 5*a*, the magenta developing cartridge 5*b*, the cyan developing cartridge 5*c*, and the black developing cartridge 5*d* according to the present exemplary embodiment.

Since configurations of the photosensitive drums 1*a*, 1*b*, 1*c*, and 1*d* on which the toner images are formed by the yellow developing cartridge 5*a*, the magenta developing cartridge 5*b*, the cyan developing cartridge 5*c*, the black developing cartridge 5*d* are similar, the photosensitive drum 1 is used for the description of the photosensitive drums 1*a* to 1*d* according to the present exemplary embodiment.

The pressure mechanism of the developing cartridge 5 to the photosensitive drum 1 is described with reference to FIG. 1, and FIGS. 3 to 9.

Figure 3:
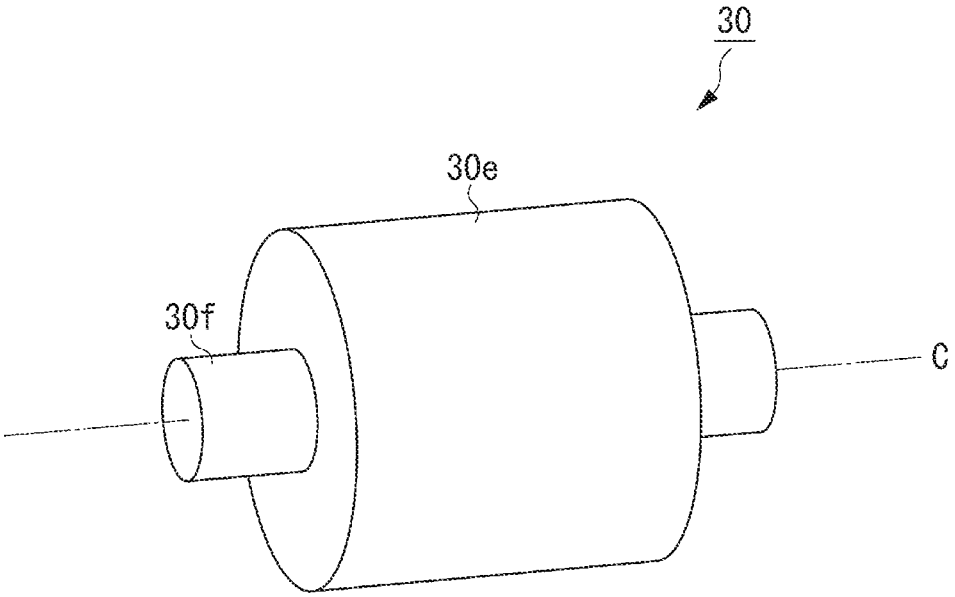
FIG. 3 is a schematic perspective view illustrating a pressure member.
Figure 4:
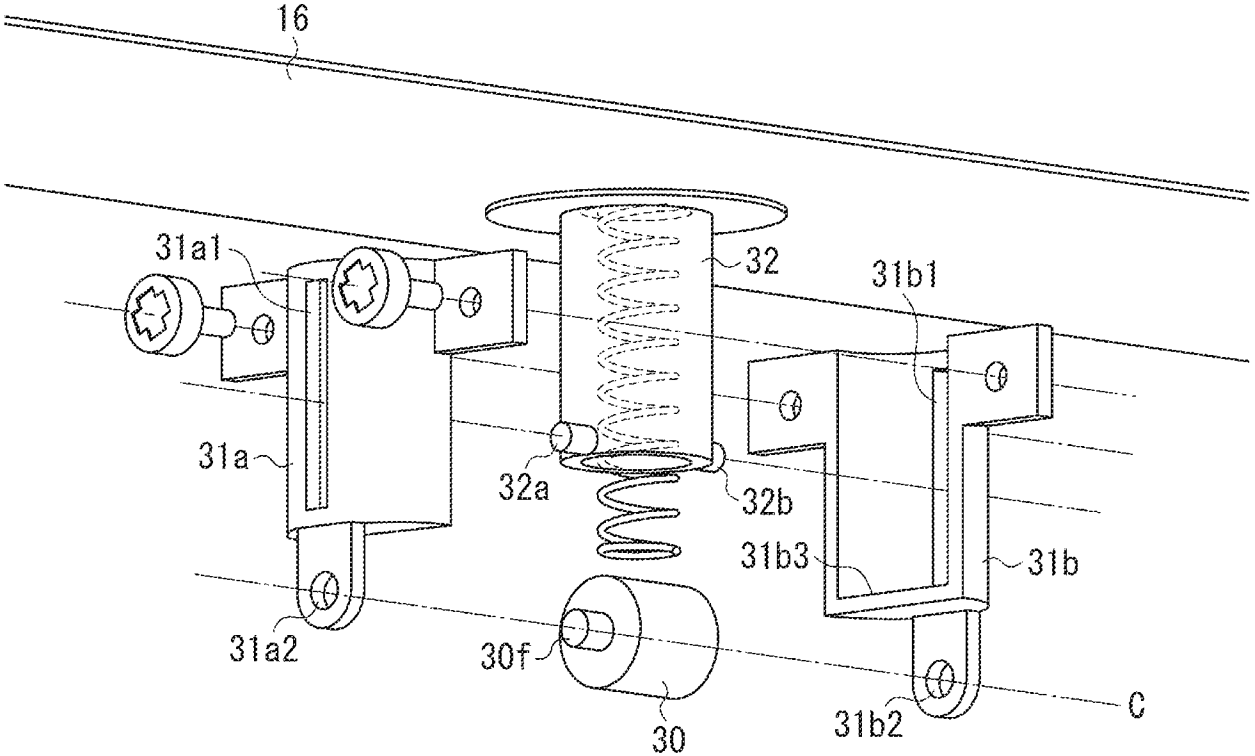
FIG. 4 is a schematic exploded perspective view illustrating a pressure mechanism.
Figure 5A:
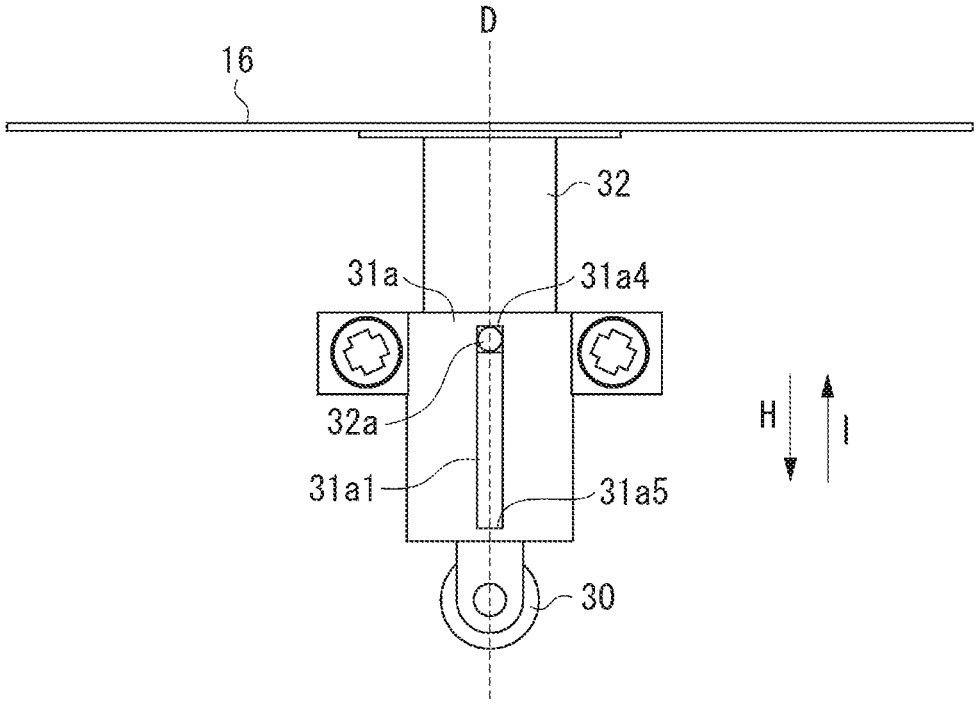
FIGS. 5A and 5B are schematic diagrams illustrating the pressure mechanism.
Figure 5B:
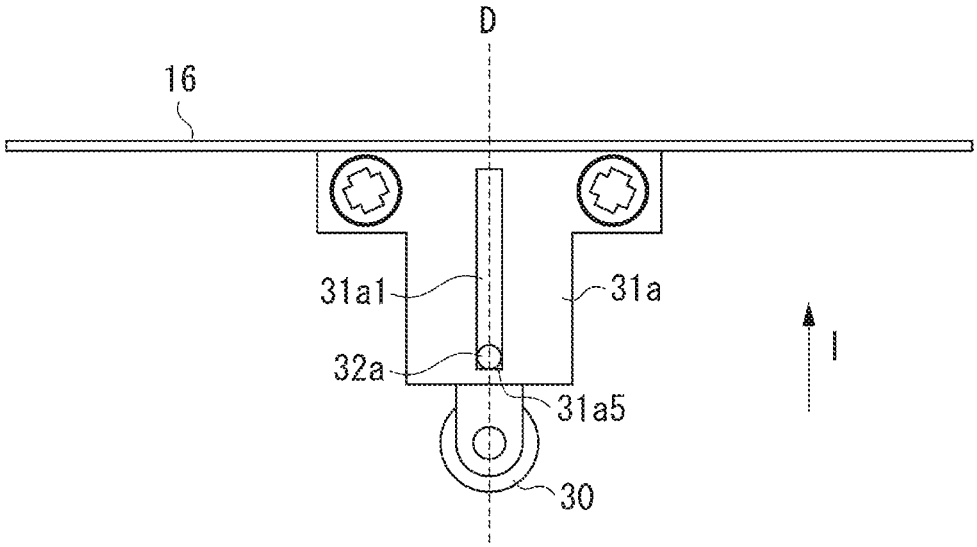
Figure 6:
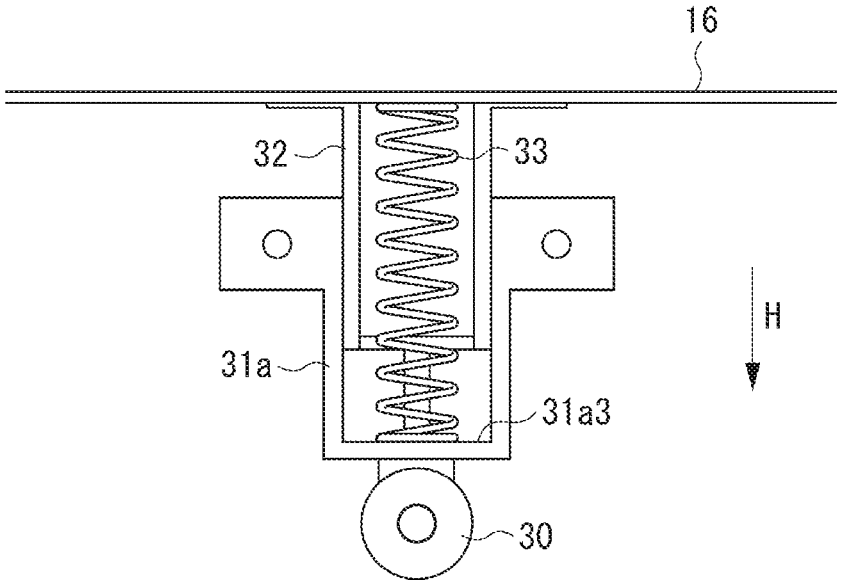
FIG. 6 is a schematic cross-sectional view illustrating the pressure mechanism.
Figure 7:
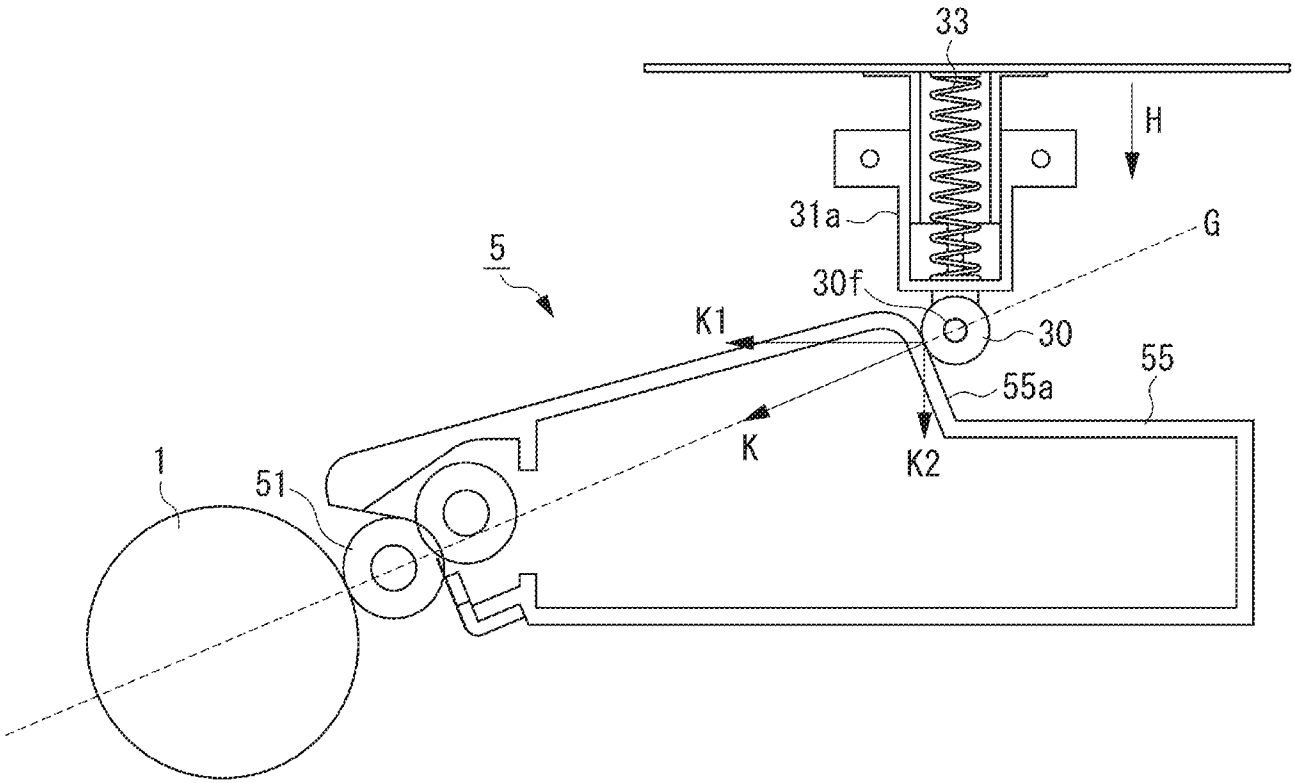
FIG. 7 is a schematic cross-sectional view illustrating the image forming main assembly and the developing cartridge.
Figure 8:
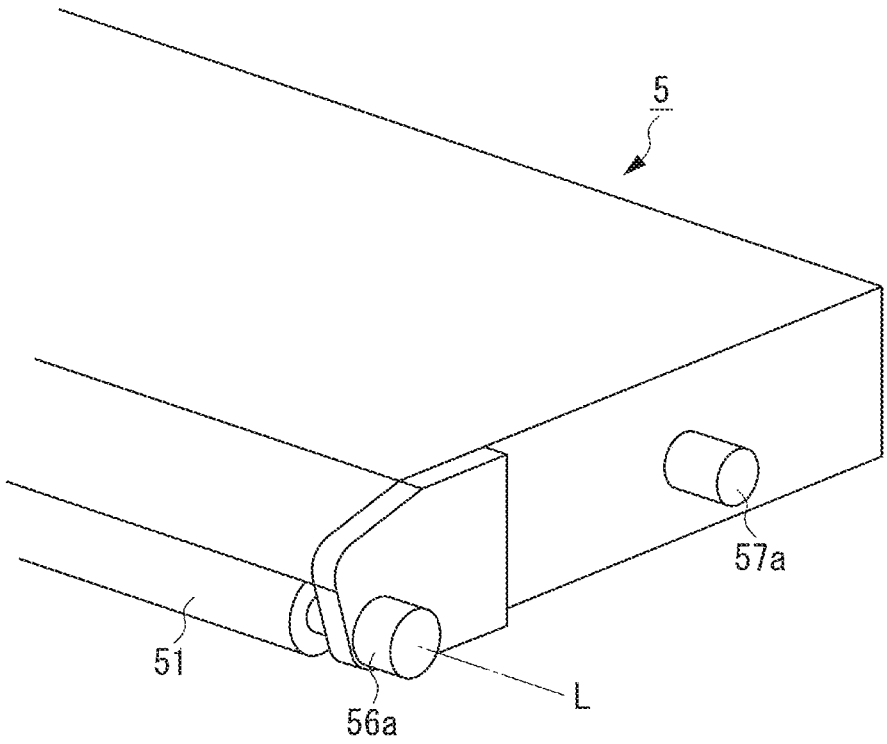
FIG. 8 is a schematic perspective view illustrating the developing cartridge.
Figure 9:
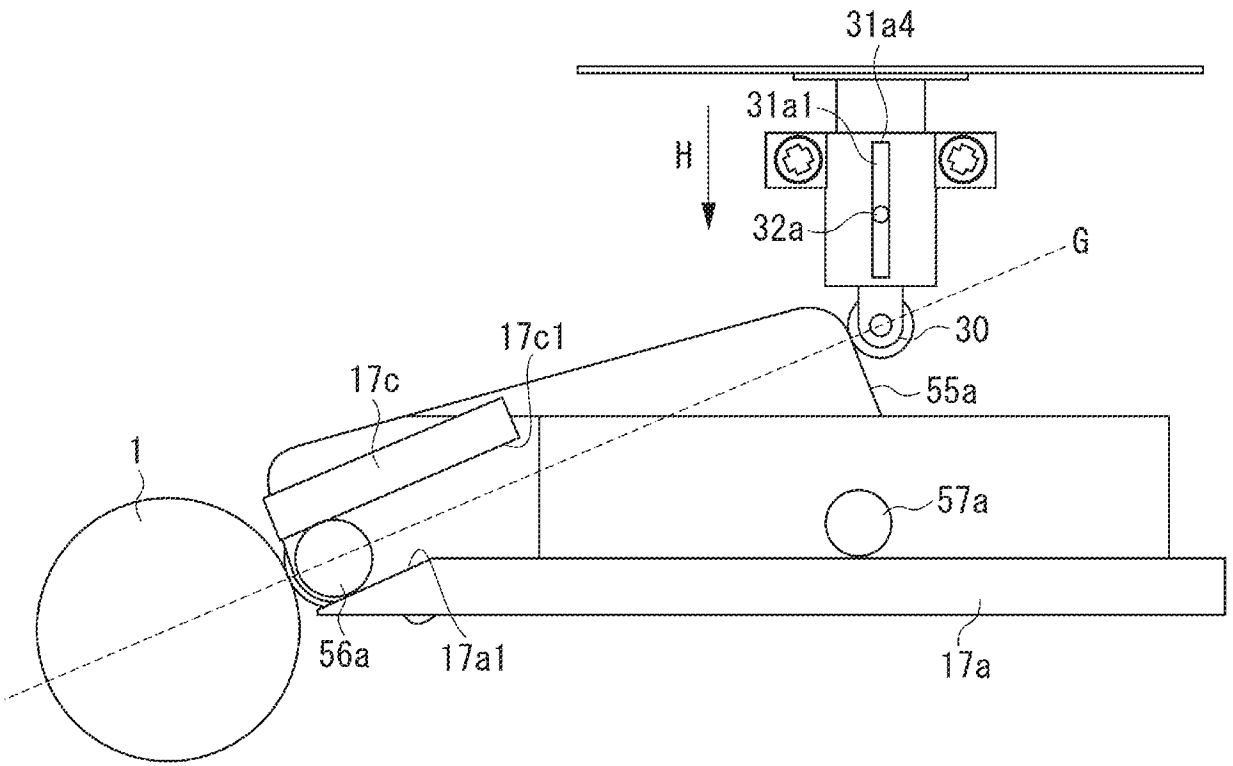
FIG. 9 is a schematic diagram illustrating the image forming main assembly and the developing cartridge.

FIG. 3 is a schematic perspective view illustrating a pressure member 30 according to the present exemplary embodiment. FIG. 4 is a schematic exploded perspective view illustrating a pressure mechanism according to the present exemplary embodiment. FIGS. 5A and 5B are schematic diagrams illustrating the pressure mechanism according to the present exemplary embodiment. FIG. 6 is a schematic cross-sectional view illustrating the pressure mechanism according to the present exemplary embodiment. FIG. 7 is a schematic cross-sectional view illustrating the main assembly 100A of the image forming apparatus 100 and the developing cartridge 5 according to the present exemplary embodiment. FIG. 8 is a schematic perspective view illustrating the developing cartridge 5 according to the present exemplary embodiment. FIG. 9 is a schematic diagram illustrating the main assembly 100A of the image forming apparatus 100 and the developing cartridge 5 according to the present exemplary embodiment.

Referring to FIG. 1, the main assembly of the image forming apparatus 100 includes the pressure member 30 that presses the developing cartridge 5 to the photosensitive drum 1. Referring to FIG. 3, the pressure member 30 includes a rubber roll unit 30*e* and a rigid shaft 30*f*. The rigid shaft 30*f* penetrates through the rubber roll unit 30*e* in a direction of a straight line C in FIG. 3 as a rotational axial direction of the pressure member 30, and both ends thereof are projected from the rubber roll unit 30*e*.

Referring to FIG. 4, in the pressure member 30, both ends of the rigid shaft 30*f* are supported by through holes 31*a*2 and 31*b*2 provided in bearing members 31*a* and 31*b*. The pressure member 30 is supported by the bearing members 31*a* and 31*b* to be rotatable around the straight line C in FIG. 4 as a rotational axis of the pressure member 30.

On the other hand, as illustrated in FIG. 4, a slide shaft member 32 is provided to an intermediate plate 16 disposed in the main assembly of the image forming apparatus 100. The slide shaft member 32 is cylindrically-hollow-shaped, and an outer circumferential surface with the cylindrical shape has slide regulation ribs 32*a* and 32*b*. As illustrated in FIG. 4, the bearing members 31*a* and 31*b* include slit holes 31*a*1 and 31*b*1 through which the slide regulation ribs 32*a* and 32*b* penetrate.

As illustrated in FIGS. 4, 5A, and 5B, the slit holes 31*a*1 and 31*b*1 have long hole shapes. The pressure member 30 is therefore movable in a direction of a straight line D in FIGS. 5A and 5B in parallel with the slit holes 31*a*1 and 31*b*1.

Further, as illustrated in FIG. 6, a compression spring 33 is arranged in a cylindrically hollow shape of the slide shaft member 32. The compression spring 33 is compressed by the intermediate plate 16 and contact surfaces 31*a*3 and 31*b*3 of the bearing members 31*a* and 31*b*. Therefore, the bearing members 31*a* and 31*b* and the pressure member 30 are urged in a direction of an arrow H in FIG. 6.

At this time, the slit holes 31*a*1 and 31*b*1 are provided with the bearing members 31*a* and 31*b*, as described above, so that the slide regulation ribs 32*a* and 32*b* arranged to the slide shaft member 32 can penetrate therethrough. Therefore, the movement amounts of the bearing members 31*a* and 31*b* in the direction of the arrow H in FIG. 6 are regulated.

More specifically, as illustrated in FIG. 5A, the position at which the slide regulation rib 32*a* abuts a projection regulation wall 31*a*4 of the slit hole 31*a*1 is the maximum projection position of the bearing members 31*a* and 31*b* and the pressure member 30 in a direction of an arrow H in FIG. 5A. Therefore, when urging force is not externally applied to the bearing members 31*a* and 31*b* and the pressure member 30, the bearing members 31*a* and 31*b* and the pressure member 30 are held at the maximal projected position. If the urging force is applied to the bearing members 31*a* and 31*b* or the pressure member 30 in a direction of an arrow I in FIG. 5B, the bearing members 31*a* and 31*b* and the pressure member 30 are moved to a maximal retreat position where the slide regulation rib 32*a* abuts a retreat regulation wall 31*a*5 of the slid hole 31*a*1.

In a mounting state of the developing cartridge 5 to the main assembly 100A of the image forming apparatus 100, as illustrated in FIG. 7, a first pressed surface (pressed portion) 55*a* for receiving the pressure from the pressure member 30 provided in the main assembly 100A of the image forming apparatus 100, is provided in the developer container 55. As illustrated in FIG. 7, the pressed surface 55*a* is provided in such a manner that a part of the first pressed surface 55*a* is orthogonal to a straight line G in FIG. 7 obtained by connecting the center of the photosensitive drum 1 and the center of the developing roller 51.

Further, as described above, the pressure member 30 is rotatably supported around the rigid shaft 30*f* as the center by the bearing members 31*a* and 31*b*, and is urged in a direction of an arrow H in FIG. 7. Further, as illustrated in FIG. 9, the pressure member 30 is not projected to a position at which the slide regulation rib 32*a* abuts the projection regulation wall 31*a*4 of the slit hole 31*a*1.

Urging force is applied to a contact surface of the pressed surface 55*a* with the pressure member 30 in a direction of an arrow K in FIG. 7 as a vertical direction on the contact surface of the pressure member 30. That is, in the state where the developing cartridge 5 is mounted to the main assembly 100A of the image forming apparatus 100, the urging force is applied to the developing cartridge 5 in the direction of the arrow K in FIG. 7 on the straight line G in FIG. 7 obtained by connecting the center of the photosensitive drum 1 and the center of the developing roller 51 from the pressure member 30.

Referring to FIG. 8, a cylindrical regulation boss 56*a* with a rotational axis L of the developing roller 51 as a center and a mounting/detaching guide boss 57*a* are provided on the one end side of the developing roller 51 of the developing cartridge 5 in a direction of a straight line L in FIG. 8 as a direction of a rotational axis as the center of the developing roller 51 of the developing cartridge 5. As illustrated in FIG. 8, on the other end side, the regulation boss 56*a* and the mounting/detaching guide boss 57*a* are arranged at symmetrical positions to the one end side.

Since the configurations of the regulation bosses 56*a* and the configurations of the mounting/detaching guide bosses 57*a* and 57*b* provided on both end sides are similar, a description is given by using the regulation boss 56*a* and the mounting/detaching guide boss 57*a* on the one end side. As illustrated in FIG. 9, a mounting/detaching guide 17*a* and a regulation guide 17*c* in the pressing direction are provided on the one end side of the image forming apparatus 100 in the direction of the straight line L in FIG. 8. On the other end side, a mounting/detaching guide 17*b* (not illustrated) and a regulation guide 17*d* in the pressing direction (not illustrated) are arranged at symmetrical positions of the mounting/detaching guide 17*a* and the regulation guide 17*c* in the pressing direction on the one end side, as illustrated in FIG. 9.

Since configurations of the mounting/detaching guides 17*a* and the regulation guides 17*c* in the pressing direction on both end sides thereof are similar, a description is given by using the mounting/detaching guide 17*a* and the regulation guide 17*c* in the pressing direction on one end side.

When the developing cartridge 5 is mounted to the main assembly 100A of the image forming apparatus 100, a regulation surface 17*a*1 of the mounting/detaching guide 17*a* that guides the regulation boss 56*a* is arranged in parallel with the straight line G in FIG. 7, obtained by connecting the center of the photosensitive drum 1 and the center of the developing roller 51. Further, a regulation surface 17*c*1 of the regulation guide 17*c* in the pressing direction that guides the regulation boss 56*a* is also arranged in parallel with the straight line G.

With the configurations, when urging force in a direction of an arrow K is applied from the pressure member 30 to the developing cartridge 5 on the straight line G obtained by connecting the center of the photosensitive drum 1 and the center of the developing roller 51, the center of the developing roller 51 is pressed to the center of the photosensitive drum 1.

A mounting/detaching operation of the developing cartridge 5 with respect to the image forming apparatus 100 is described with reference to FIGS. 10 to 13B.

Figure 10:
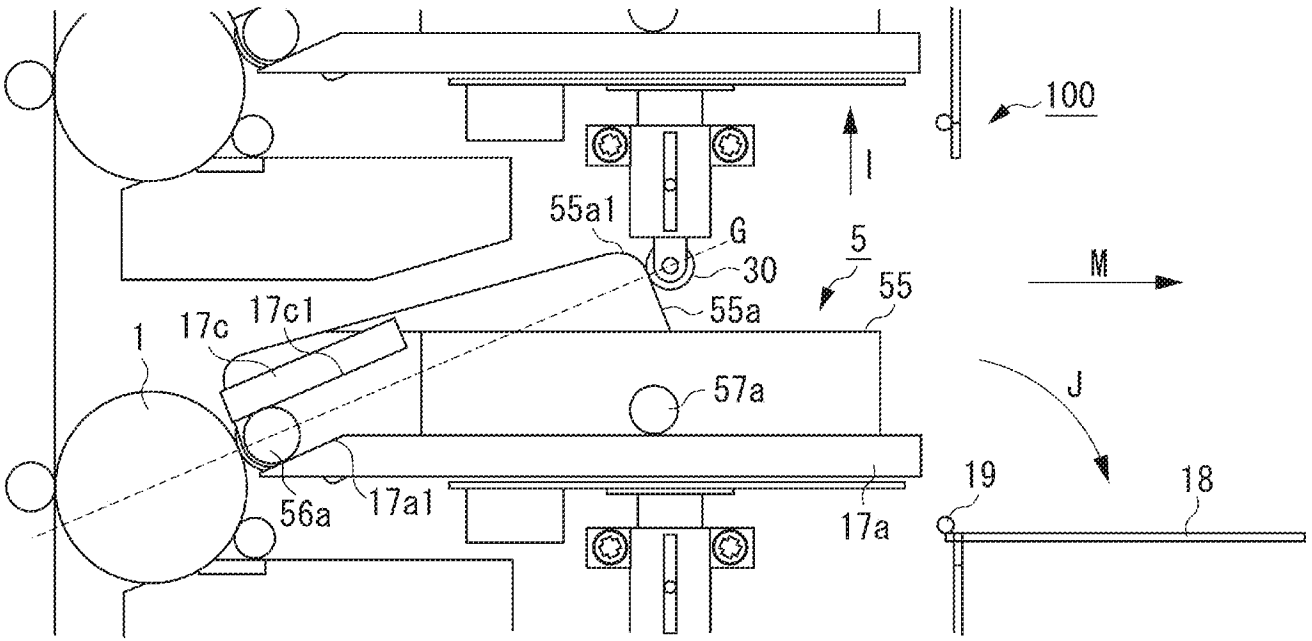
FIG. 10 is a schematic diagram illustrating an image forming apparatus in an open state of a mounting/detaching cover.
Figure 11A:
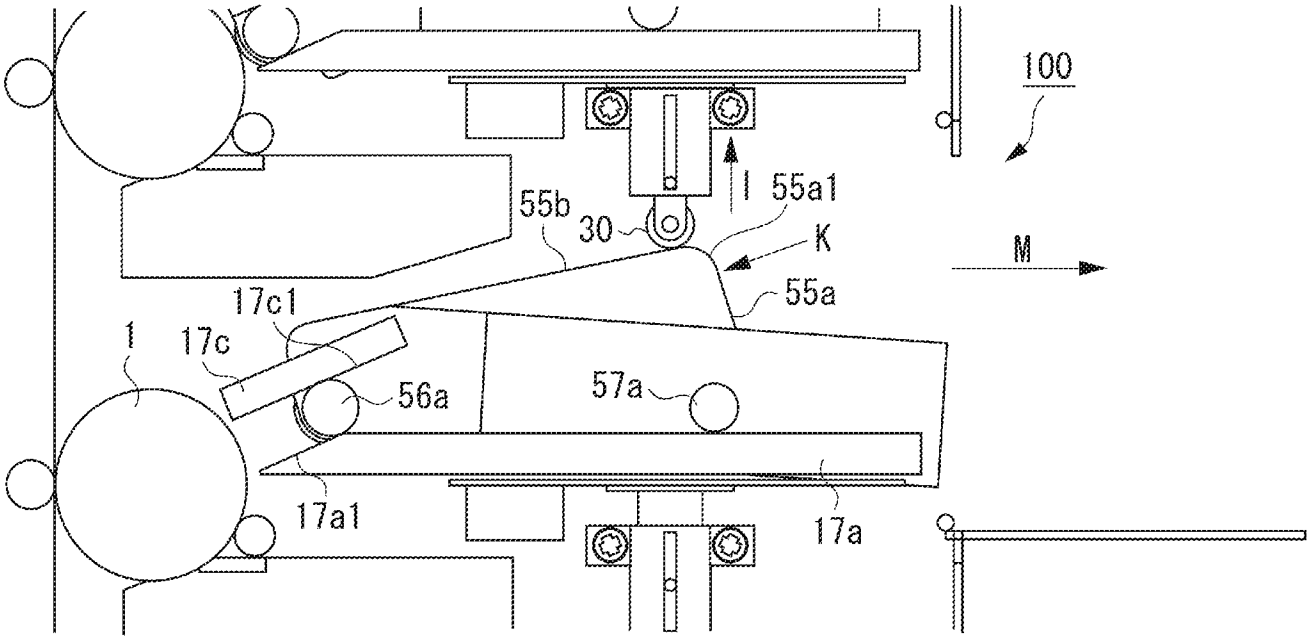
FIGS. 11A and 11B are schematic diagrams each illustrating a state when the developing cartridge is pulled out from the image forming main assembly.
Figure 11B:
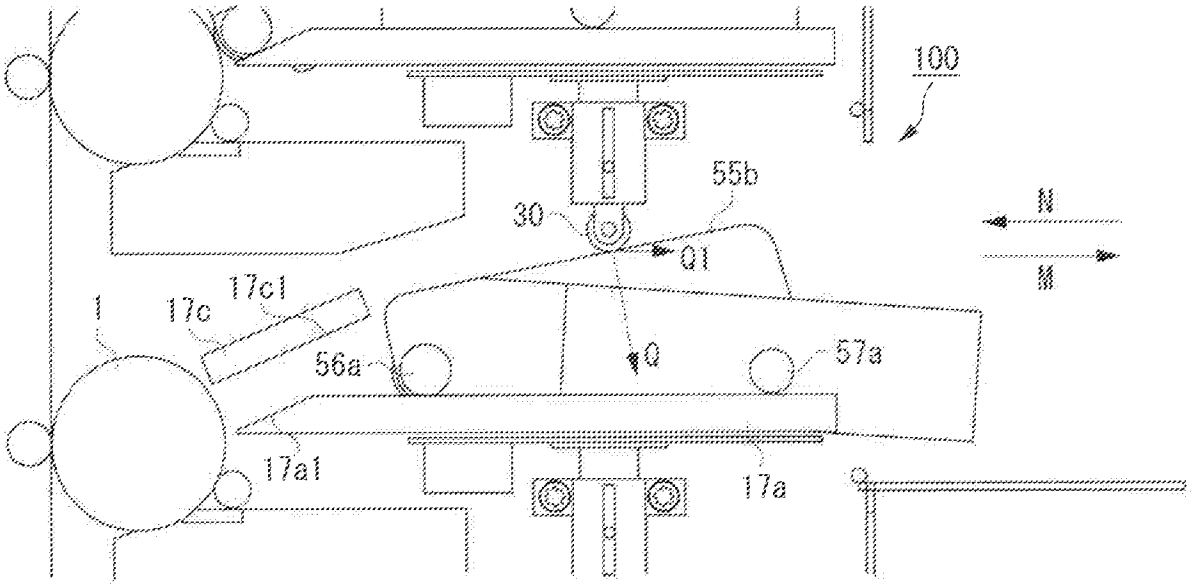
Figure 12A:
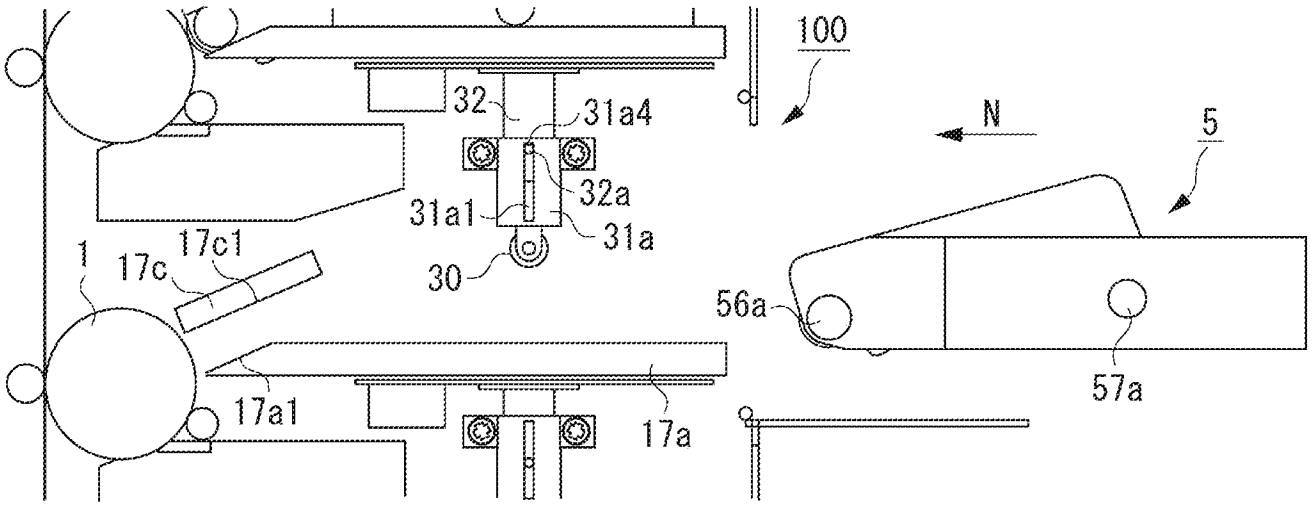
FIGS. 12A and 12B are schematic diagrams each illustrating a state in which the developing cartridge is mounted to the image forming main assembly.
Figure 12B:
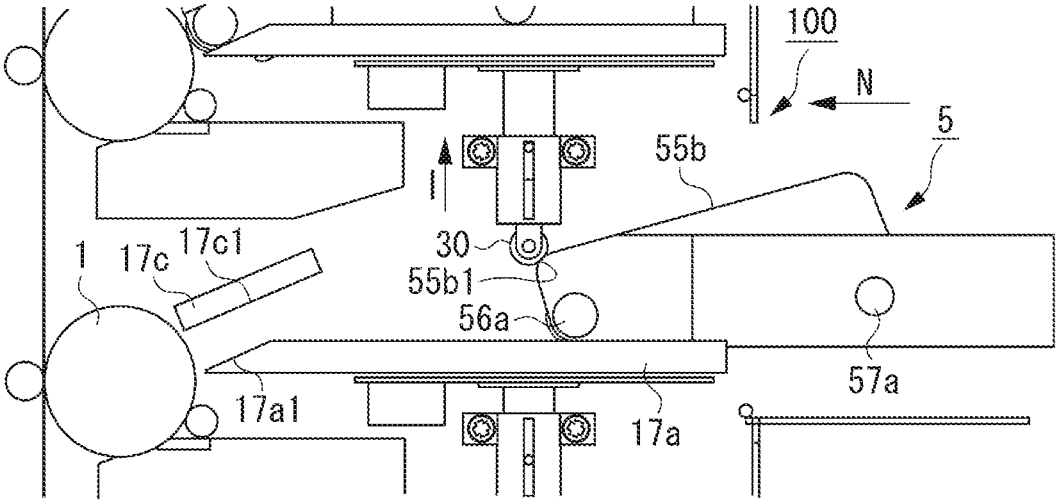
Figure 13A:
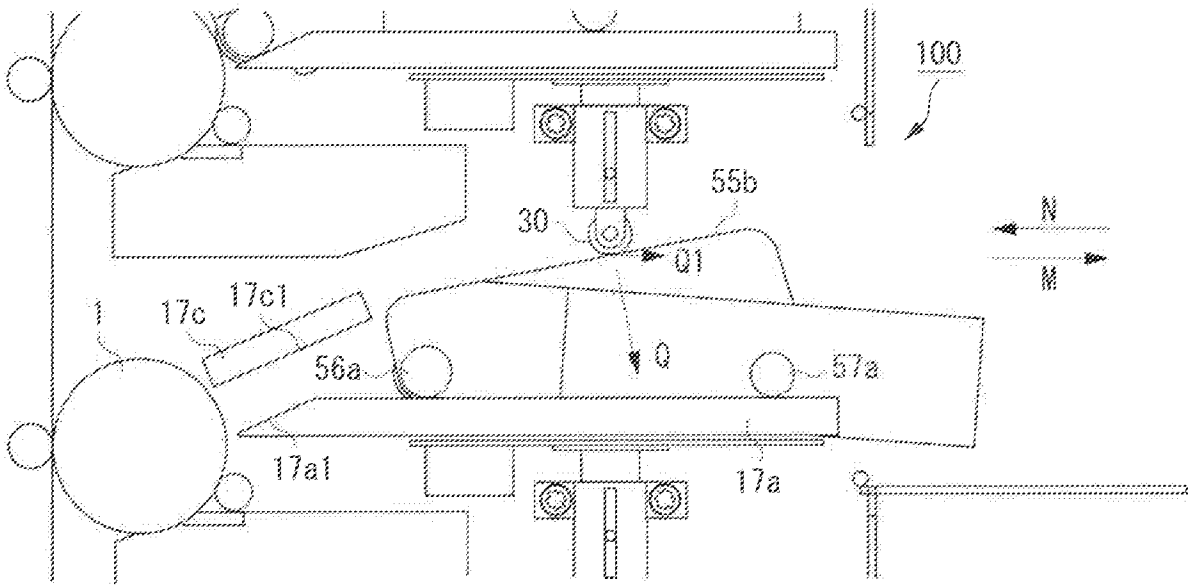
FIGS. 13A and 13B are schematic diagrams each illustrating a states in which the developing cartridge is mounted to the image forming main assembly.
Figure 13B:
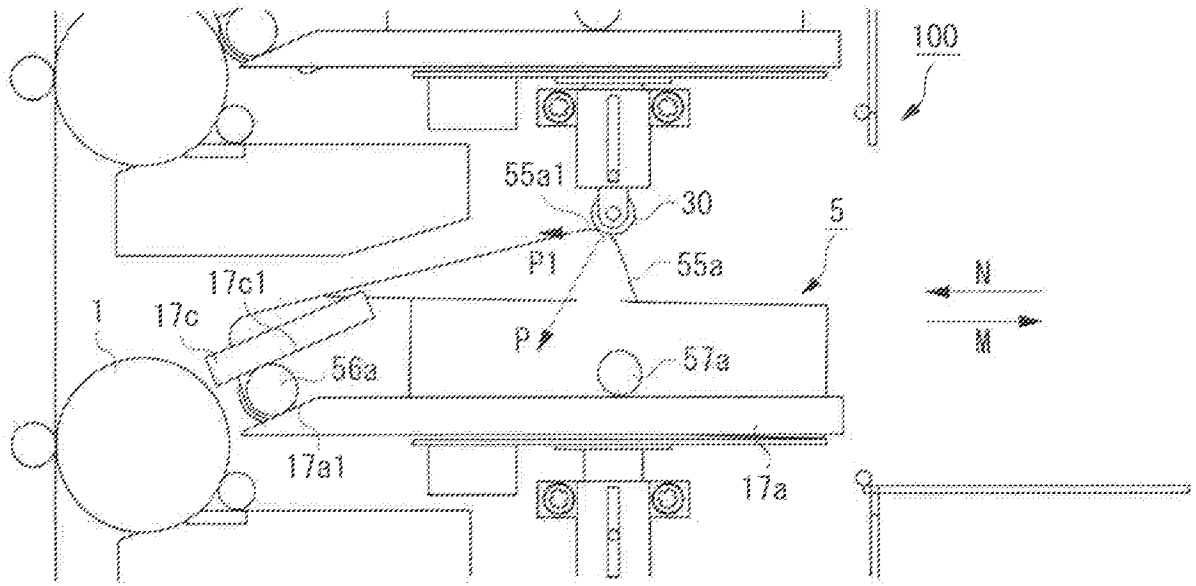

FIG. 10 is a schematic diagram illustrating the image forming apparatus 100 when a mounting/detaching cover 18 is opened according to the present exemplary embodiment. FIGS. 11A and 11B are schematic diagrams illustrating a state when the developing cartridge 5 is pulled out from the main assembly 100A of the image forming apparatus 100 according to the present exemplary embodiment. FIGS. 12A and 12B are schematic diagrams each illustrating a state when the developing cartridge 5 is mounted to the main assembly 100A of the image forming apparatus 100 according to the present exemplary embodiment. FIGS. 13A and 13B are schematic diagrams each illustrating a state when the developing cartridge 5 is mounted to the main assembly 100A of the image forming apparatus 100 according to the present exemplary embodiment.

Since the mounting/detaching operations of the yellow developing cartridge 5*a*, the magenta developing cartridge 5*b*, the cyan developing cartridge 5*c*, and the black developing cartridge 5*d* to/from the main assembly 100A of the image forming apparatus 100 and configurations thereof are similar, a description is given of the mounting/detaching of the yellow developing cartridge 5*a*, the magenta developing cartridge 5*b*, the cyan developing cartridge 5*c*, and the black developing cartridge 5*d* to/from the main assembly 100A of the image forming apparatus 100 and the configuration thereof according to the present exemplary embodiment by using the developing cartridge 5.

Referring to FIG. 10, when the developing cartridge 5 is pulled out from the main assembly 100A of the image forming apparatus 100, the mounting/detaching cover 18 is opened in a direction of an arrow J in FIG. 10 around the mounting/detaching cover rotational axis 19 as the center, thereby allowing access to the developing cartridge 5. In the opening state of the mounting/detaching cover 18, the developing cartridge 5 is moved in a direction of an arrow M in FIG. 10 as a pull-out direction from the main assembly 100A of the image forming apparatus 100.

Then, the pressed surface 55*a* provided on the developer container 55 of the developing cartridge 5 presses the pressure member 30 in a direction of an arrow I in FIG. 10. The pressure member 30 is moved in a direction of an arrow I in FIG. 11A. The developing cartridge 5 is further moved in the direction of the arrow M in FIG. 10. Then, as illustrated in FIG. 11A, the pressure member 30 climbs over a curvature surface 55*a*1 as is a part of the pressed surface 55*a*.

Urging force, which is applied to the developing cartridge 5 from the pressure member 30, from the center of the developing roller 51 to the center of the photosensitive drum 1 in a direction of an arrow K in FIG. 11A, is released.

Referring to FIG. 11B, the pressure member 30 comes into contact with a pull-out auxiliary surface 55*b* as a part of a unique identification portion arranged to the developer container 55 of the developing cartridge 5. At this time, urging force applied to the developing cartridge 5 from the pressure member 30 is in a direction of an arrow Q in FIG. 11B. A component in a mounting/detaching direction of the developing cartridge 5 is in the same direction of an arrow Q1 in FIG. 11B as a direction of an arrow M in FIG. 11B as a pull-out direction of the developing cartridge 5.

In other words, when the developing cartridge 5 is moved in the direction of the arrow M in FIG. 10, and the pressure member 30 climbs over the curvature surface 55*a*1, the urging force of the developing cartridge 5 applied from the pressure member 30 is changed in the direction of the arrow M in FIG. 11B as the pull-out direction of the developing cartridge 5. Thus, the urging force is reduced when the user pulls out the developing cartridge 5 from the main assembly 100A of the image forming apparatus 100, and the developing cartridge 5 is easily pulled out.

When mounting the developing cartridge 5 to the image forming apparatus 100, the developing cartridge 5 is moved in a direction of an arrow N in FIG. 12A. At this time, the urging force is not applied to the pressure member 30, and the slide regulation rib 32*a* of the slide shaft member 32 is held at the maximal projection position abutting the projection regulation wall 31*a*4 of the slit hole 31*a*1 of the bearing member 31*a*.

Referring to FIG. 12B, when the developing cartridge 5 is moved to the contact position with the pressure member 30, a curvature surface 55*b*1 as is a part of the pull-out auxiliary surface 55*b* presses the pressure member 30 in a direction of an arrow I in FIG. 12B, and the pressure member 30 is then moved in the direction of the arrow I in FIG. 12B. The developing cartridge 5 is further moved in a direction of an arrow N in FIG. 12B, urging force is applied to the developing cartridge 5 from the pressure member 30 in a direction of an arrow Q in FIG. 13A.

A component in the detaching direction of the developing cartridge 5 is in the same direction of an arrow Q1 in FIG. 13A as a direction of an arrow M in FIG. 13A as a take-out extracting direction of the developing cartridge 5. Referring to FIG. 13B, when the pressure member 30 is inserted to a contact position with the pressed surface 55*a* as a part of a climb-over identification portion of the curvature surface 55*a*1, urging force is applied to the developing cartridge 5 from the pressure member 30 in a direction of an arrow P in FIG. 13B.

At this time, a component in a mounting/detaching direction of the developing cartridge 5 of the urging force applied from the pressure member 30 to the developing cartridge is in the same direction of an arrow P1 in FIG. 13B as that of an arrow N in FIG. 13B as the mounting direction of the developing cartridge 5. Referring to FIG. 10, the developing cartridge 5 is pulled into a contact position between the developing roller 51 and the photosensitive drum 1. The center of the developing roller 51 is pressed to that of the photosensitive drum 1 from the pressure member 30.

Before and after the pressure member 30 climbs over the curvature surface 55*a*1, a component of the urging force applied to the developing cartridge 5 in a mounting/detaching direction thereof changes from a direction of an arrow M in FIG. 13B opposite to the mounting direction to a direction of an arrow N in FIG. 13B as the mounting direction. Thus, when the developing cartridge 5 is mounted to the image forming apparatus 100, the user easily recognizes that the developing cartridge 5 is correctly mounted.

Prevention of an erroneous mounting of a developing cartridge is described in a case when a developing cartridge 70 with a different function is inserted into the image forming apparatus 100 with reference to FIGS. 14 to 19. The developing cartridge 70 with a different function is detachably mountable to another image forming apparatus with a function different from that of the image forming apparatus 100.

Figure 14:
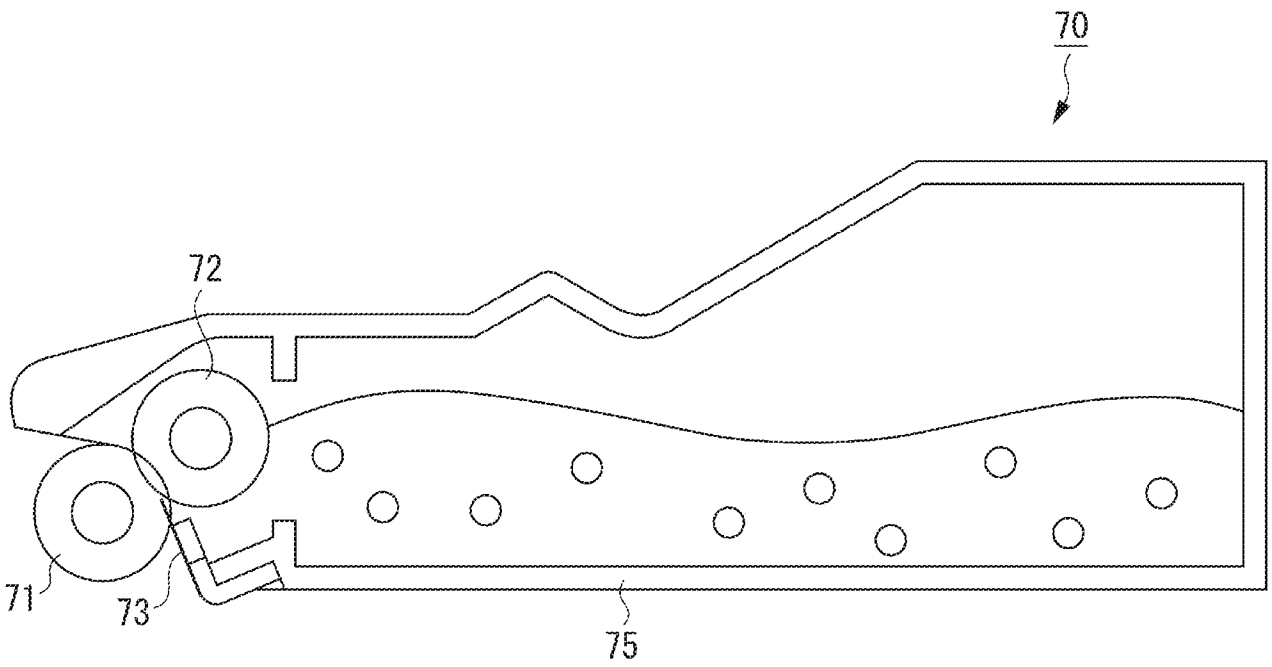
FIG. 14 is a schematic cross-sectional view illustrating a developing cartridge with a different function.
Figure 15A:
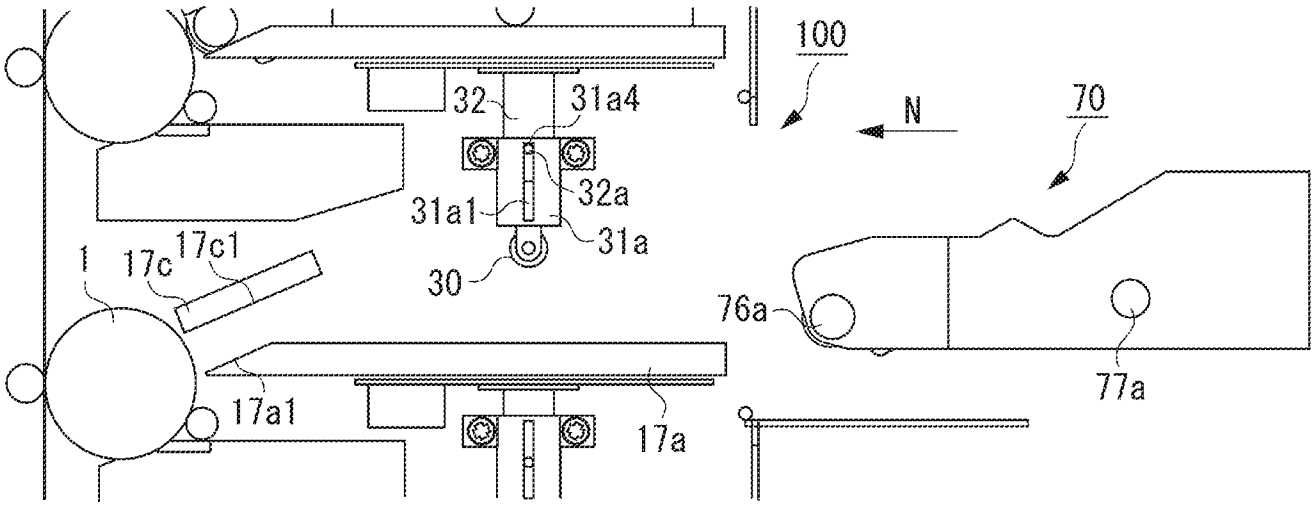
FIGS. 15A and 15B are schematic diagrams each illustrating a state when the developing cartridge with the different function is mounted to the image forming main assembly.
Figure 15B:
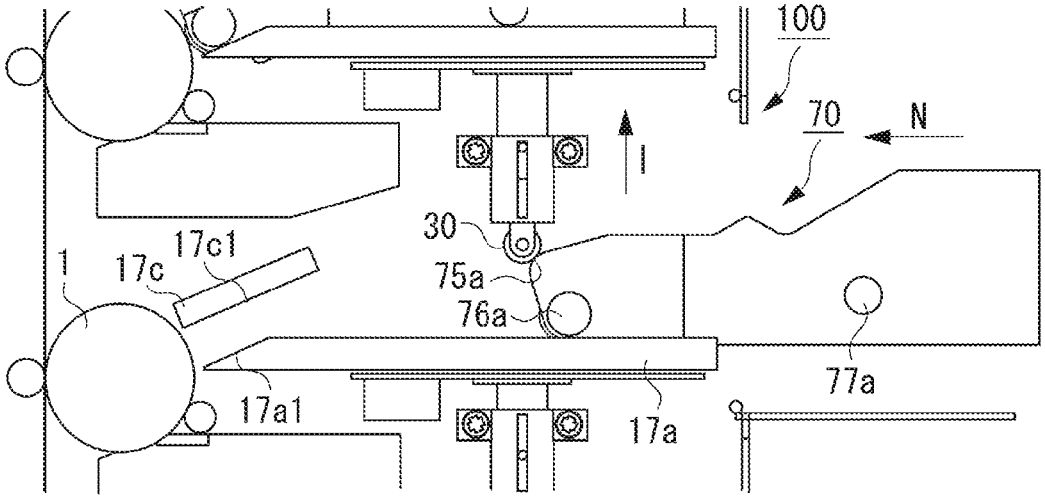
Figure 16A:
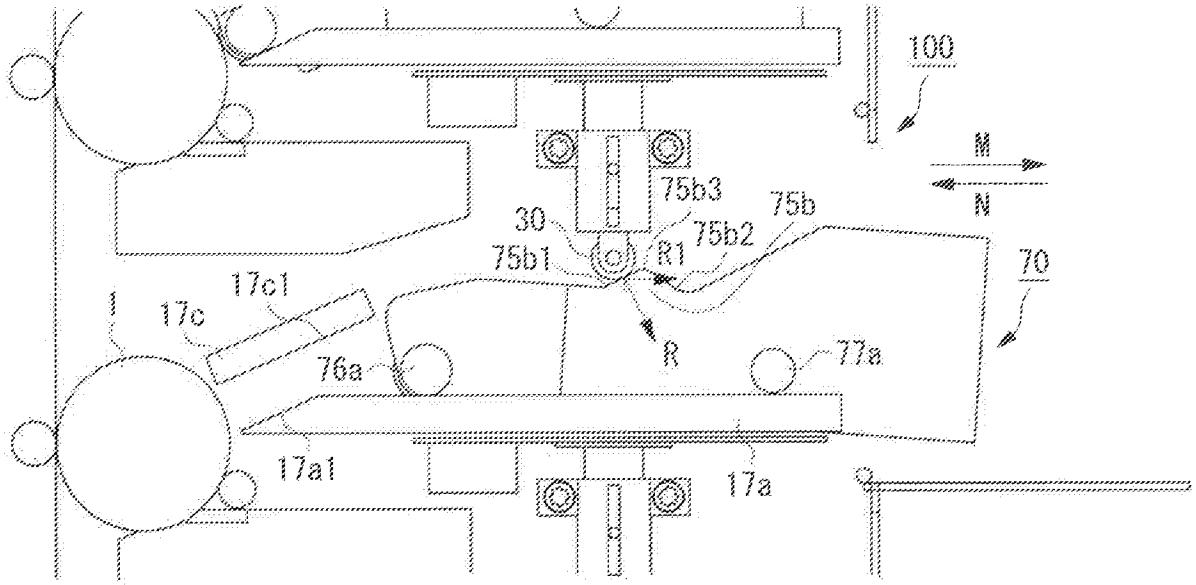
FIGS. 16A and 16B are schematic diagrams each illustrating a state when the developing cartridge with the different function is mounted to the image forming main assembly.
Figure 16B:
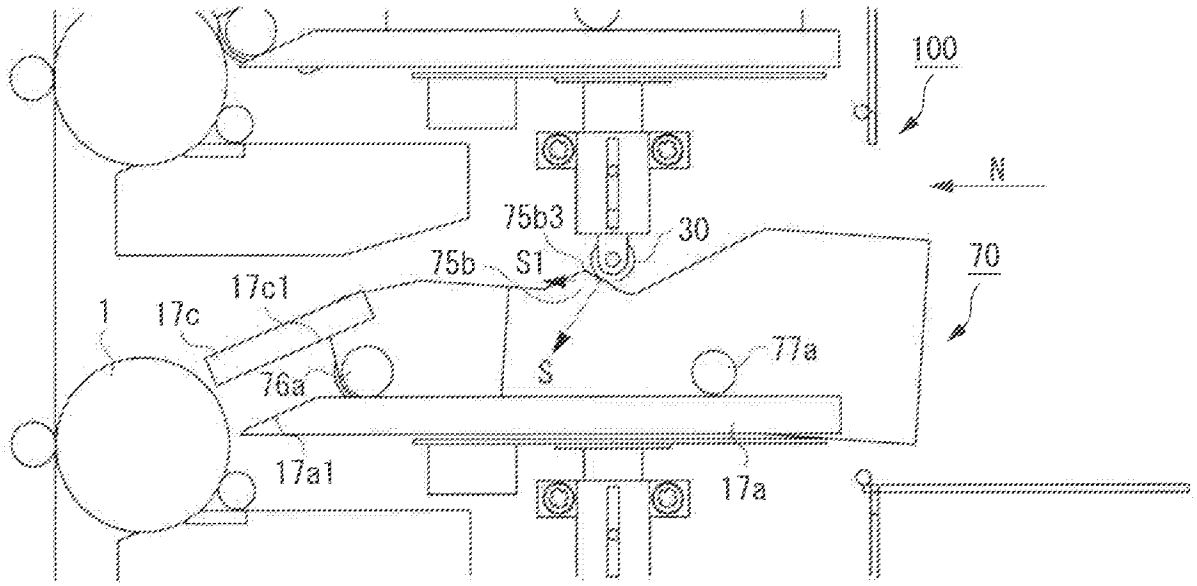

FIG. 14 is a schematic cross-sectional view illustrating the developing cartridge 70 with the different function according to the present exemplary embodiment. FIGS. 15A and 15B are schematic diagrams each illustrating a state when the developing cartridge 70 with the different function is mounted to the main assembly 100A of the image forming apparatus 100 according to the present exemplary embodiment. FIGS. 16A and 16B are schematic diagrams illustrating a state when the developing cartridge 70 with the different function is mounted to the main assembly 100A of the image forming apparatus 100 according to the present exemplary embodiment.

Figure 17A:
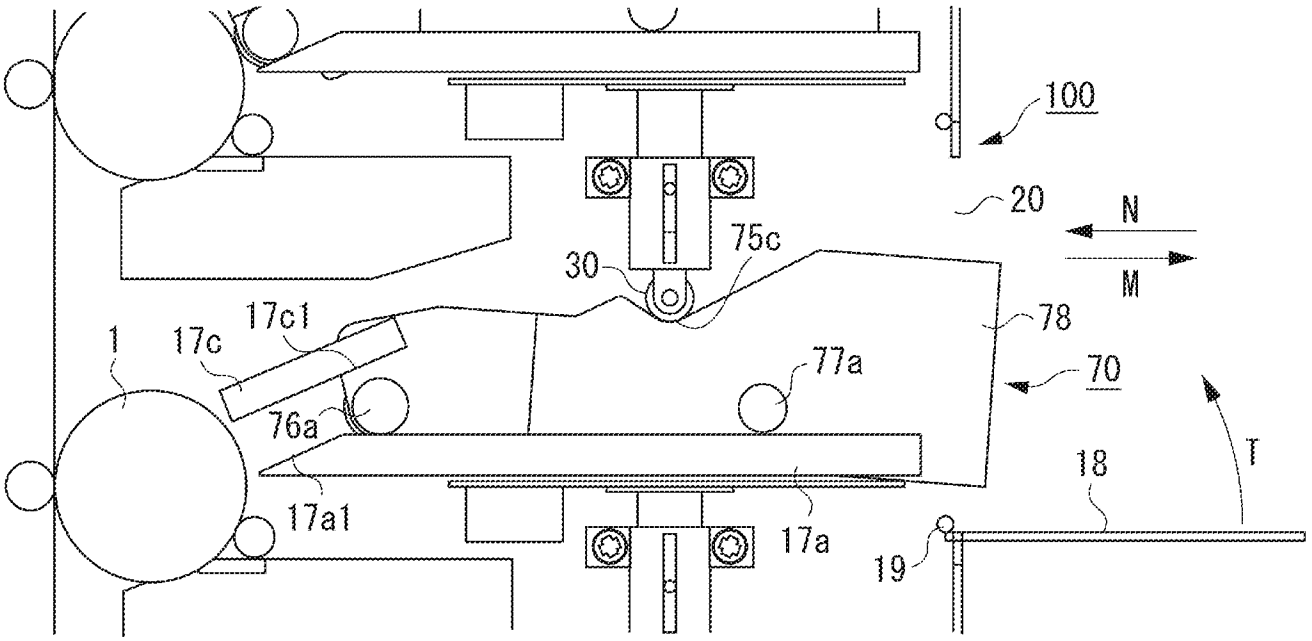
FIGS. 17A and 17B are schematic diagrams each illustrating a state when the developing cartridge with the different function is mounted to the image forming main assembly.
Figure 17B:
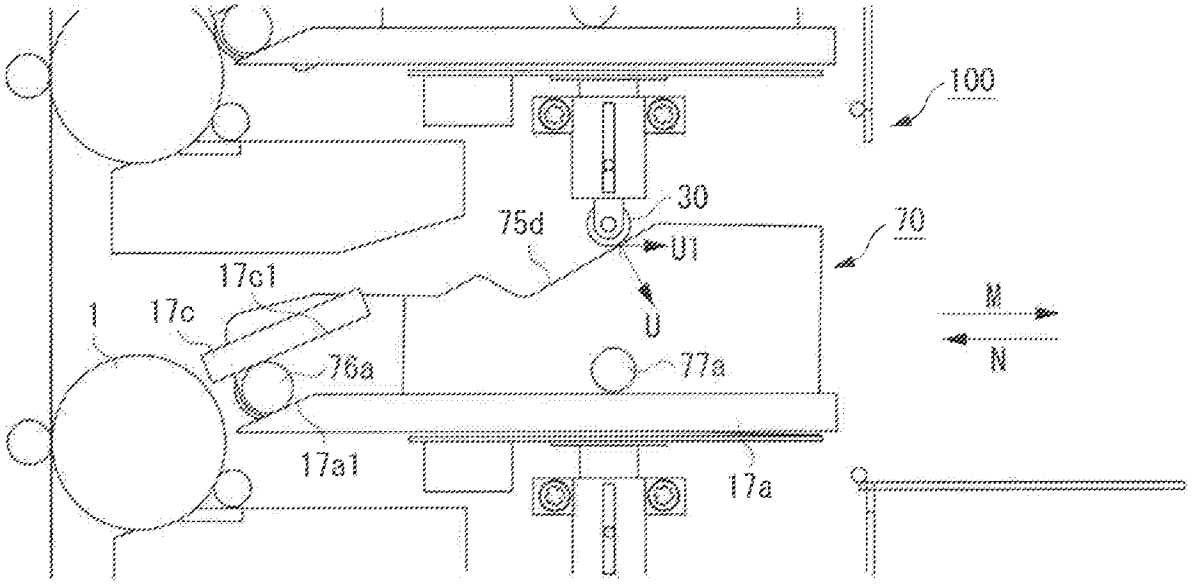
Figure 18A:
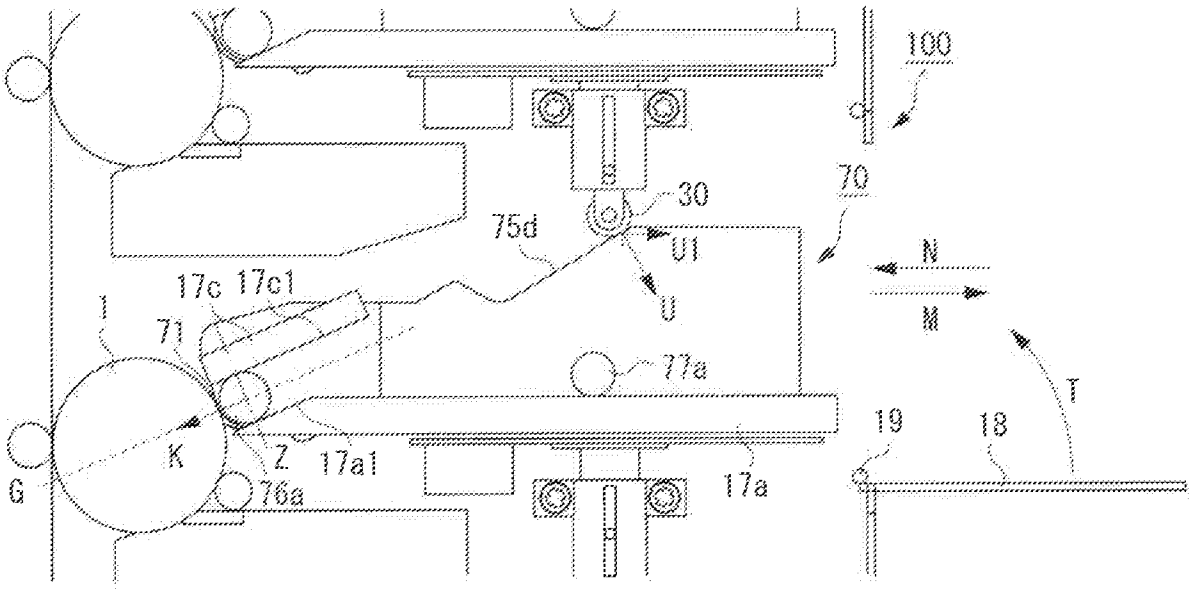
FIGS. 18A and 18B are schematic diagrams each illustrating a state when the developing cartridge with the different function is mounted to the image forming main assembly.
Figure 18B:
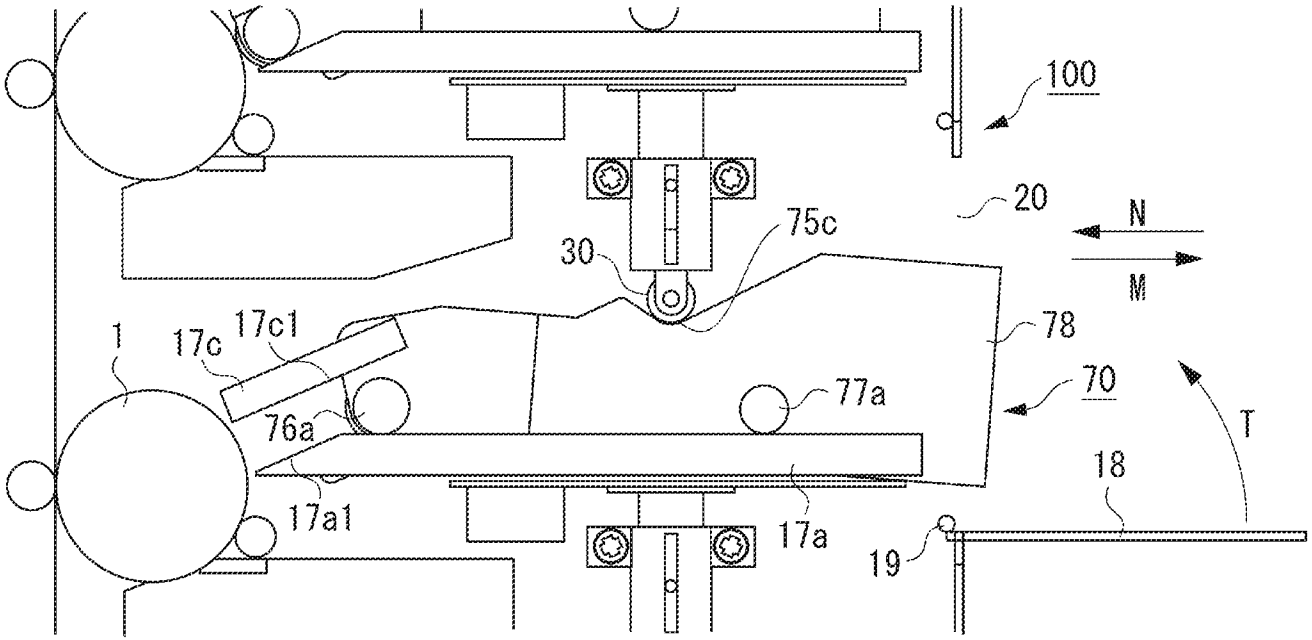
Figure 19:
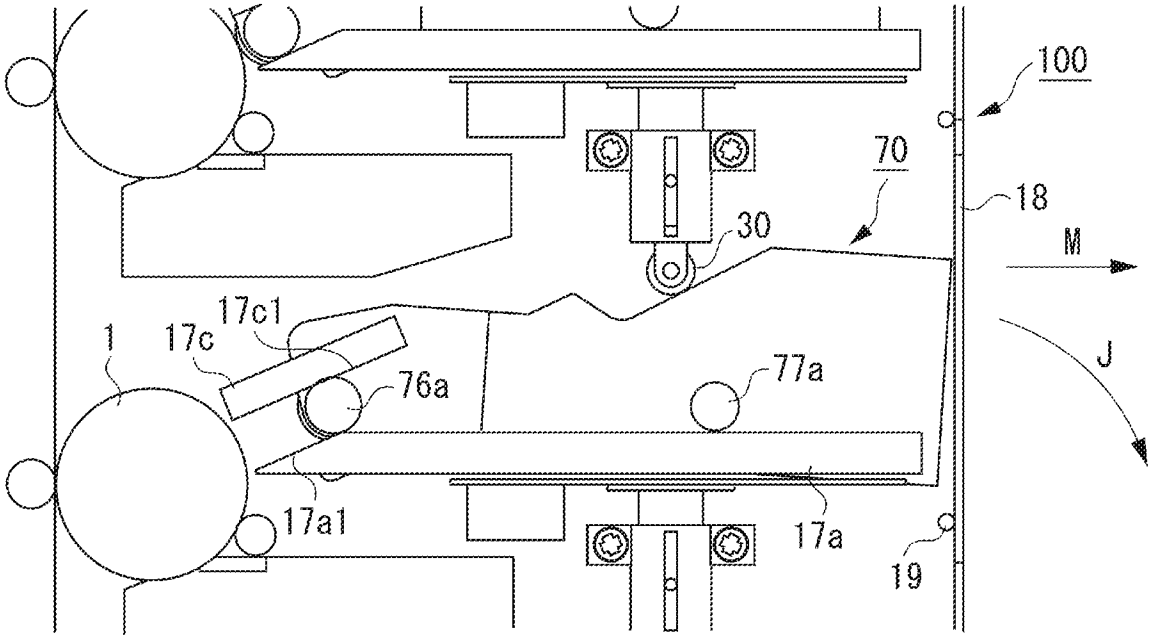
FIG. 19 is a schematic diagram illustrating a state where the developing cartridge with the different function is inserted into the image forming main assembly.

FIGS. 17A and 17B are schematic diagrams each illustrating a state when the developing cartridge 70 with the different function is mounted to the main assembly 100A of the image forming apparatus 100 according to the present exemplary embodiment. FIGS. 18A and 18B are schematic diagrams each illustrating a state when the developing cartridge 70 with the different function is mounted to the main assembly 100A of the image forming apparatus 100 according to the present exemplary embodiment. FIG. 19 is a schematic diagram illustrating a state when the developing cartridge 70 with the different function is inserted into the main assembly 100A of the image forming apparatus 100 according to the present exemplary embodiment.

Referring to FIG. 14, a configuration of the developing cartridge 70 with the different function is similar to that of the developing cartridge 5, other than a shape of a developer container 75. A toner supply roller 72 and a developing blade 73 are provided on the developing cartridge 70. Therefore, a specific description of the developing cartridge 70 is omitted, and only a configuration for preventing an erroneous mounting is described when the user erroneously mounts the developing cartridge 70 with the different function to the image forming apparatus 100.

A regulation boss 76*a* and a mounting/detaching guide boss 77*a* are provided on the developing cartridge 70. When the user erroneously tries to mount the developing cartridge 70 with the different function to the main assembly 100A of the image forming apparatus 100, as illustrated in FIG. 15A, the developing cartridge 70 is moved in a direction of an arrow N in FIG. 15A. At this time, the pressure member 30 is held at the maximal projection position where the slide regulation rib 32*a* of the slide shaft member 32 abuts the projection regulation wall 31*a*4 of the slit hole 31*a*1 of the bearing member 31*a*.

Referring to FIG. 15B, when the developing cartridge 70 is moved to come into contact with the pressure member 30, a curvature surface 75*a* as is apart of the developer container 75 presses the pressure member 30 in a direction of an arrow I in FIG. 15B, and the pressure member 30 is moved in the direction of the arrow I in FIG. 15B.

When the developing cartridge 70 is further moved in a direction of an arrow N FIG. 15B, as illustrated in FIG. 16A, the pressure member 30 comes into contact with a slope 75*b*1 of a stopper projection 75*b* provided on the developer container 75. At this time, urging force applied to the developing cartridge 70 from the pressure member 30 is in a direction of an arrow R in FIG. 16A. A component in a mounting/detaching direction of the developing cartridge 70 is in the same direction of an arrow R1 in FIG. 16A as a direction of an arrow M in FIG. 16A as a pull-out direction of the developing cartridge 70.

When the developing cartridge 70 is moved in a direction of an arrow N in FIG. 16A while the urging force in the direction of the arrow M in FIG. 16A is applied, as illustrated in FIG. 16B, the pressure member 30 climbs over an apex 75*b*3 of the stopper projection 75*b* and comes into contact with a climb-over slope 75*b*2. At this time, urging force applied to the developing cartridge 70 from the pressure member 30 is in a direction of an arrow S in FIG. 16B. A component in a mounting/detaching direction of the developing cartridge 70 is in a direction of an arrow S1 in FIG. 16A that is the same as the direction of the arrow N in FIG. 16B as a mounting direction of the developing cartridge 70.

Urging force is applied to the developing cartridge 70 from the pressure member 30. As illustrated in FIG. 17A, the pressure member 30 is moved to a contact position with a regulation portion 75*c* provided on the developer container 75. When the developing cartridge 70 is inserted to the contact position, a rear end 78 of the developing cartridge 70 is stuck out of a detachment opening 20 of the image forming apparatus 100 as illustrated in FIG. 17A.

Therefore, although the mounting/detaching cover 18 of the image forming apparatus 100 is rotated around the mounting/detaching cover rotational shaft 19 as the center in a direction of an arrow T in FIG. 17A, the mounting/detaching cover 18 cannot be closed. As a result, the user can recognize that the mounting of the developing cartridge 70 to the image forming apparatus 100 has not been completed.

Further, the developing cartridge 70 is moved in a direction of an arrow N in FIG. 17A. As illustrated in FIG. 17B, the pressure member 30 then comes into contact with a slope 75*d* for preventing an erroneous mounting as a second pressed surface (pressed portion) provided on the developer container 75. At this time, urging force is applied to the developing cartridge 70 from the pressure member 30 in a direction of an arrow U in FIG. 17B.

A component in a detaching direction of the developing cartridge 70 is in the same direction of an arrow U1 in FIG. 17B as a direction of an arrow M in FIG. 17B as the pull-out direction. As illustrated in FIG. 18A, the developing cartridge 70 is inserted to a position where a developing roller 71 comes into contact with the photosensitive drum 1.

Then, the developing roller 71 comes into contact with the photosensitive drum 1, and cannot be moved further in a direction of an arrow K in FIG. 18A as a direction from the center of the developing roller 71 to that of the photosensitive drum 1. Simultaneously, a regulation boss 76*a* comes into contact with the regulation surfaces 17*a*1 and 17*c*1, and cannot be moved in a direction of a straight line Z in FIG. 18A as a direction perpendicular to the direction of the arrow K in FIG. 18A. Therefore, the developing cartridge 70 cannot be inserted anymore in a direction of an arrow N in FIG. 18A.

At this time, the pressure member 30 is kept contact with the slope 75*d* for preventing the erroneous mounting provided on the developer container 75. Thus, urging force is still applied to the developing cartridge 70 in a direction of an arrow M FIG. 18A (opposite to a mounting direction) as the pull-out direction of the developing cartridge 70.

If the user thinks that the mounting of the developing cartridge 70 to the image forming apparatus 100 has been completed, and leaves the user's hand from the developing cartridge 70, the developing cartridge 70 is moved in the direction of the arrow M in FIG. 18A. That is, the developing cartridge 70 is moved on an upstream side of the mounting direction. As long as the urging force is applied to the developing cartridge 70 in the direction of the arrow M in FIG. 18A, the developing cartridge 70 is moved in the direction of the arrow M in FIG. 18A. Therefore, while the pressure member 30 contacts the slope 75*d* for preventing the erroneous mounting, the developing cartridge 70 is continuously moved in the direction of the arrow M in FIG. 18A. As illustrated in FIG. 18B, the developing cartridge 70 stops at a position where the pressure member 30 contacts the regulation portion 75*c*.

By providing the regulation portion 75*c*, the developing cartridge 70 is continuously moved in a direction of an arrow M in FIG. 18B to prevent the dropout from the image forming apparatus 100. Further, as described above, a part of the developing cartridge 70 is stuck out of the detachment opening 20 of the image forming apparatus 100 at the contact position of the pressure member 30 with the regulation portion 75*c*, as illustrated in FIG. 18B.

Therefore, although the mounting/detaching cover 18 of the image forming apparatus 100 is rotated around the mounting/detaching cover rotational shaft 19 as the center in a direction of an arrow T in FIG. 18B, the mounting/detaching cover 18 cannot be closed. As a result, the user can recognize that the developing cartridge 70 cannot be mounted to the image forming apparatus 100.

When the user inserts the developing cartridge 70 in a state in FIG. 18A to forcibly close the mounting/detaching cover 18 of the main assembly 100A of the image forming apparatus 100, as illustrated in FIG. 19, the developing cartridge 70 is moved in a direction of an arrow M in FIG. 19, the mounting/detaching cover 18 is pressed in the direction of the arrow M in FIG. 19, and the mounting/detaching cover 18 is opened again. As a result, the user can recognize that the developing cartridge 70 cannot be mounted to the main assembly 100A of the image forming apparatus 100.

If the user erroneously tries to mount an improper developing cartridge 70 to the main assembly 100A of the image forming apparatus 100, the developing cartridge 70 is moved in the pull-out direction (on the upstream side of the mounting direction), and the mounting/detaching cover 18 cannot be closed.

Thus, the user can recognize the erroneous mounting at an earlier stage. The pressure member 30 of the main assembly 100A of the image forming apparatus 100 is urged to the developer container 75 of the developing cartridge 70.

Therefore, if the user tries to forcibly mount the developing cartridge 70 to the main assembly 100A of the image forming apparatus 100, it is also possible to prevent deformation of the main assembly 100A of the image forming apparatus 100 or the developing cartridge 70. Further, since the developing cartridge 70 can be inserted once near the mounting end position, the forcible mounting is hardly caused.

According to the first exemplary embodiment, the developing cartridge 70 detachably mountable to another image forming apparatus with a different function is inserted into the image forming apparatus 100. According to a second exemplary embodiment of the present invention, mounting of a developing cartridge with a different color to a mounting portion is described with reference to FIGS. 20 to 25. Only different portions from those according to the first exemplary embodiment are described.

Figure 24:
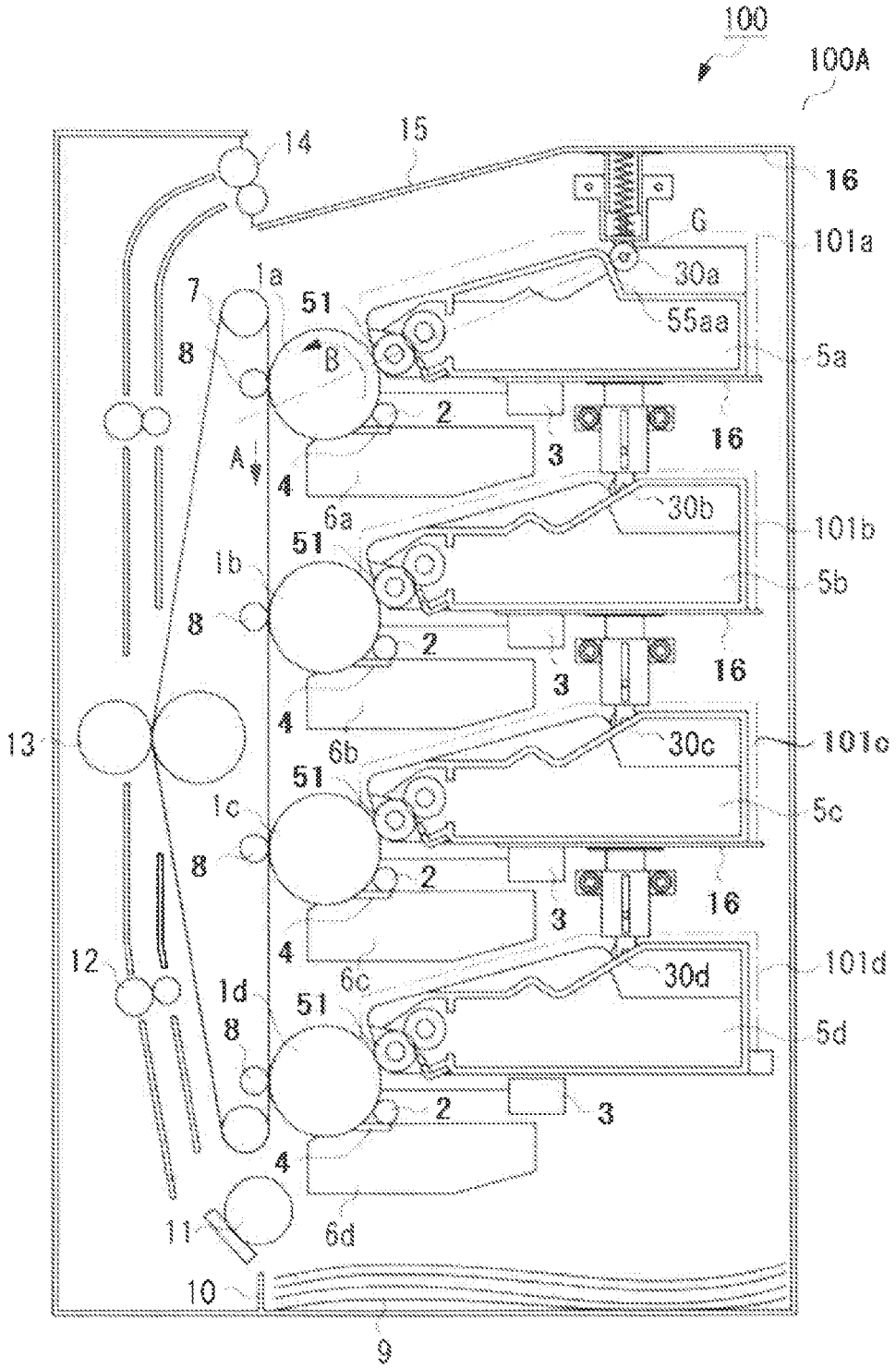
FIG. 24 is a schematic diagram illustrating the image forming main assembly and the developing cartridge.
Figure 25:
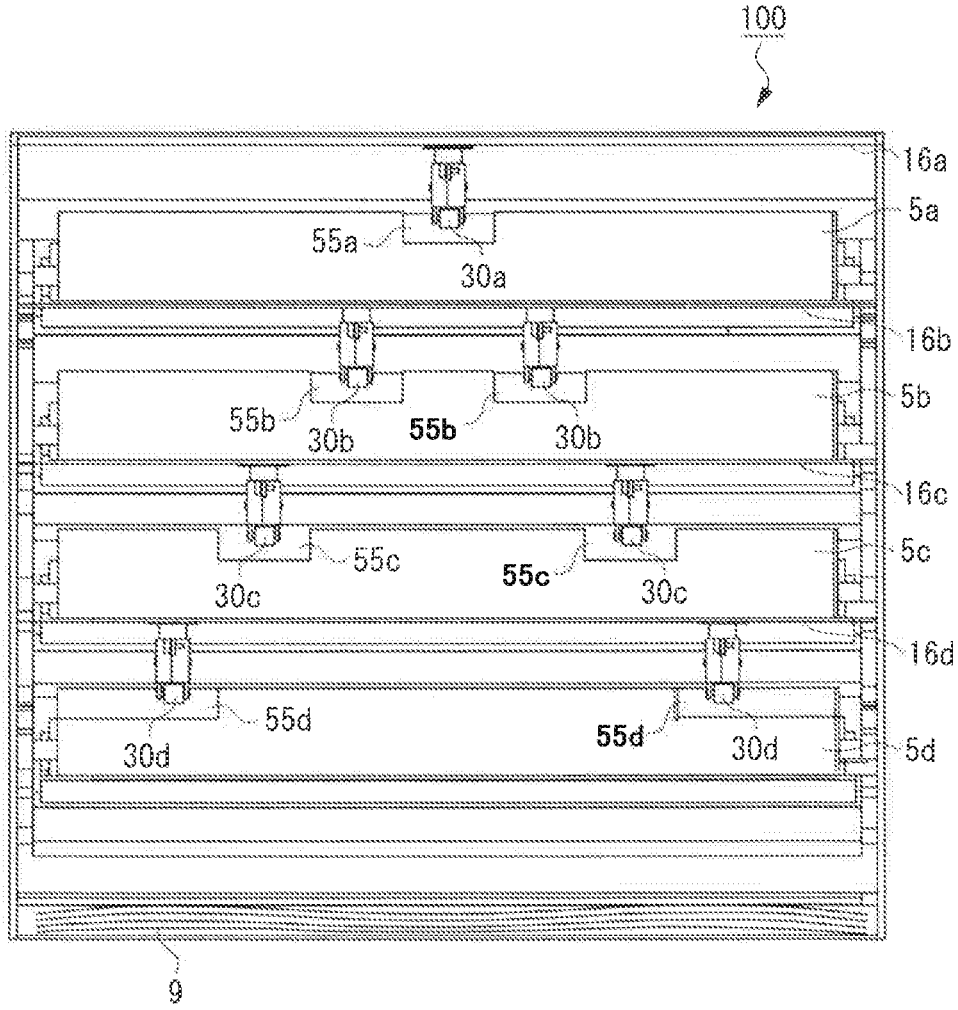
FIG. 25 is a cross-sectional view illustrating the image forming main assembly and the developing cartridge.

First, a description is given of a case of mounting the developing cartridges 5*b* to 5*d* other than the yellow developing cartridge 5*a* to the mounting portion 101*a* to which the yellow developing cartridge 5*a* in FIG. 24 is to be mounted. Configurations of the mounting portions 101*a* to 101*d* are as illustrated in FIGS. 24 and 25. That is, the pressure member 30 is provided at different positions of the mounting portions 101*a* to 101*d* in the longitudinal direction of the developing cartridge 5.

In the mounting portion 101*a*, a pressure member 30*a* is in the center of the mounting portion 101*a* in the longitudinal direction. A pressure member 30*b* provided on the mounting portion 101*b* is provided outside the pressure member 30*a* in the longitudinal direction. A pressure member 30*c* provided on the mounting portion 101*c* is positioned outside the pressure member 30*b* in the longitudinal direction. A pressure member 30*d* provided on the mounting portion 101*d* is positioned outside the pressure member 30*c* in the longitudinal direction.

Figure 20:
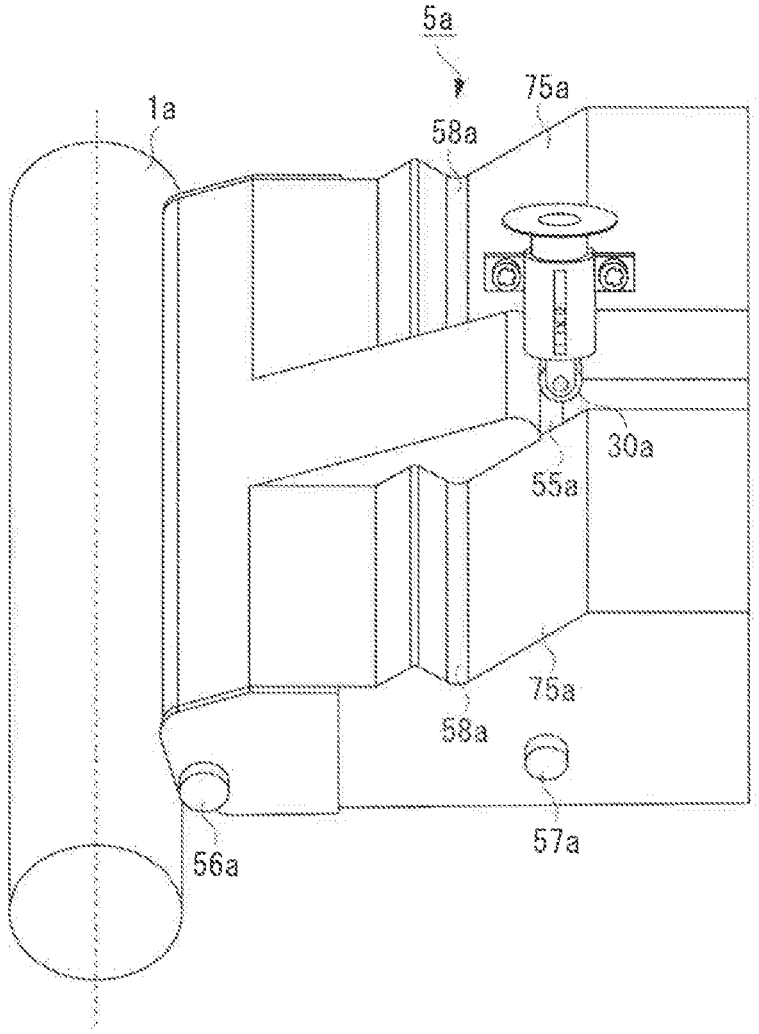
FIG. 20 is a schematic diagram illustrating a state when the developing cartridge is mounted to the image forming main assembly.

The developing cartridges 5*a* to 5*d* mountable to the mounting portions 101*a* to 101*d* have different configurations. Referring to FIG. 20, the yellow developing cartridge 5*a* has the pressed surface 55*a* at only a position corresponding to the pressure member 30*a* positioned in the center of the mounting portion 101*a*, and the surface 75*c* for preventing the erroneous mounting is provided at a position other than the corresponding position.

Figure 22:
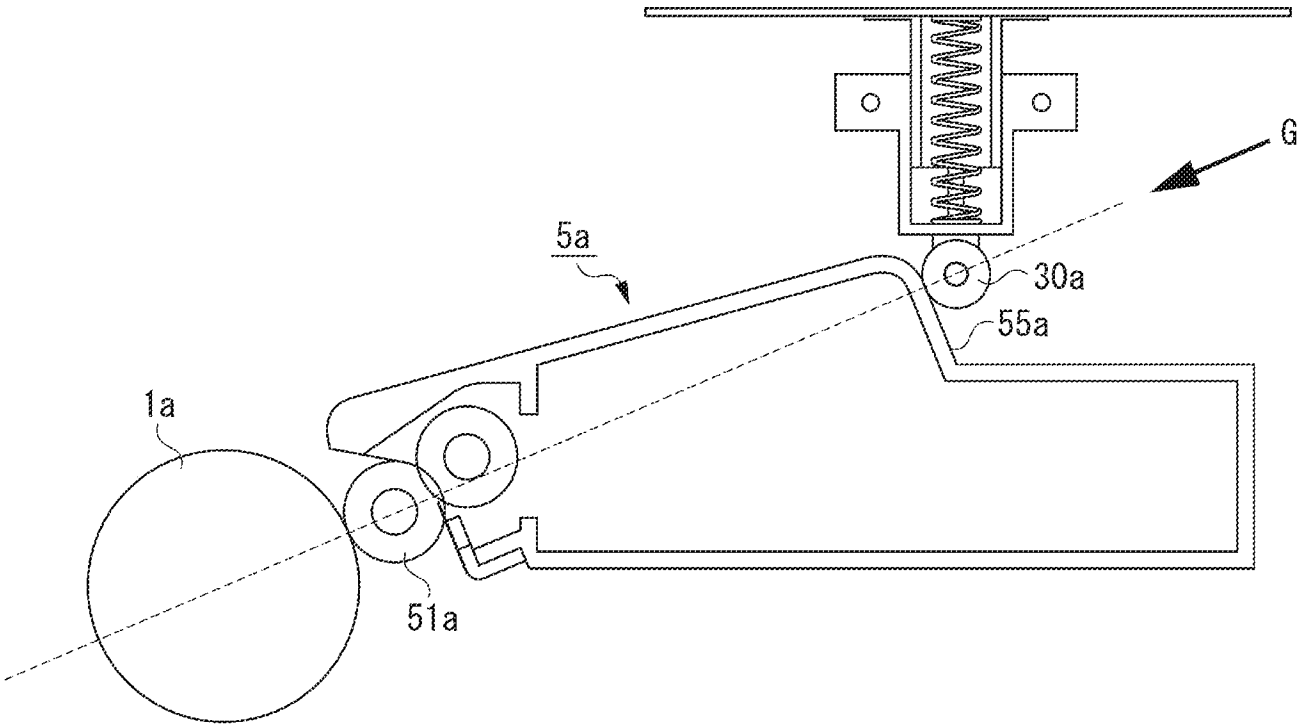
FIG. 22 is a schematic diagram illustrating a state when the developing cartridge is mounted to the image forming main assembly.

Referring to FIGS. 20 and 22, if the yellow developing cartridge 5*a* is mounted to the mounting portion 101*a*, the pressure member 30*a* acts on the pressed surface 55*a*. The developing cartridge 5*a* is pressed in a direction G for pressing the developing roller 51 to the photosensitive drum 1*a*.

Figure 21:
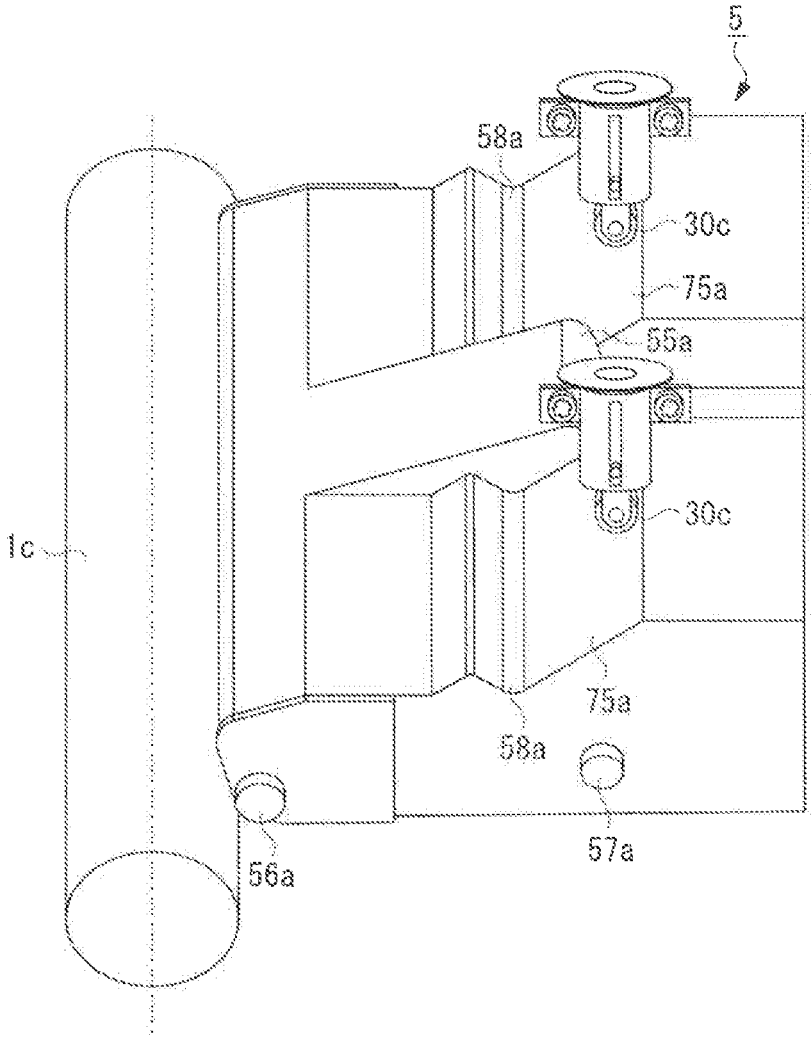
FIG. 21 is a schematic diagram illustrating a state when the developing cartridge is mounted to a mounting portion other than a predetermined one.
Figure 23:
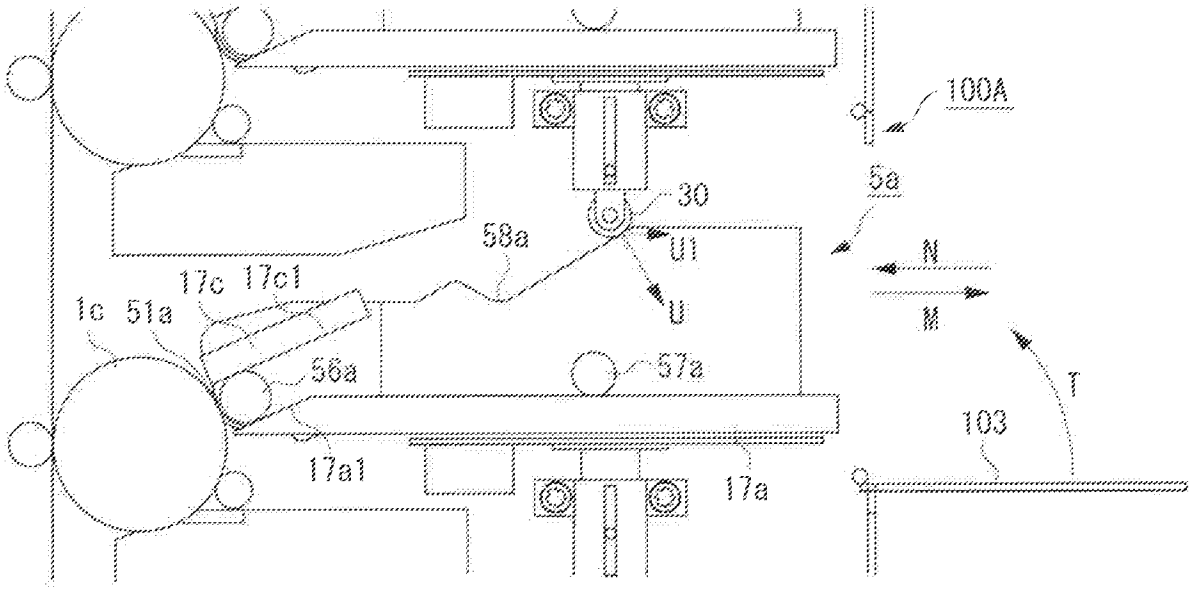
FIG. 23 is a schematic diagram illustrating a state when the developing cartridge is mounted to the mounting portion other than a predetermined mounting portion.

However, if the yellow developing cartridge 5*a* is mounted to the mounting portion 101*c* of the magenta developing cartridge 5*c*, as illustrated in FIGS. 21 and 23, the pressure member 30*c* acts on the surface 75*a* for preventing the erroneous mounting. That is, the yellow developing cartridge 5*a* is pressed and is moved on an upstream side of a mounting direction as is an opposite direction thereof. As a result, the user can confirm that the developing cartridge is not proper to the mounting portion 101*c*.

As described above in the first exemplary embodiment, a regulation portion 58*a* is provided on the developing cartridge 5*a* to prevent the dropout from the image forming apparatus 100 when the developing cartridge 5*a* is pressed on the upstream side of the mounting direction. That is, the pressure member 30*a* is engaged with the regulation portion 58*a*, thereby regulating the movement of the developing cartridge 5*a* and preventing the dropout from the image forming apparatus 100.

Although the yellow developing cartridge 5*a* is described above, other developing cartridges 5*b* to 5*d* are similar thereto. The pressed surfaces 55*b* to 55*d* are provided only at positions corresponding to the pressure members 30*b* to 30*d*. The surfaces 75*b* to 75*d* for preventing the erroneous mounting are arranged at positions other than the positions corresponding to the pressure members 30*b* to 30*d*.

Therefore, when the developing cartridges 5*b* to 5*d* are mounted to a mounting portion other than a predetermined one, the pressure member arranged to the mounting portion to which the developing cartridge is to be mounted acts on the surfaces 75*b* to 75*d* for preventing the erroneous mounting, and the developing cartridges 5*b* to 5*d* are pressed and moved on the upstream side of the mounting direction. As a result, the user can confirm that the cartridge is not proper to the mounting portion 101*c*.

Further, regulation portions 58*b* to 58*d* are arranged to the developing cartridges 5*b* to 5*d* to prevent the dropout from the image forming apparatus 100. Other configurations are similar to those according to the first exemplary embodiment. Operations and advantages are also similar to those according to the first exemplary embodiment.

According to the exemplary embodiments of the present invention, the developing cartridge is returned to the upstream side of the mounting direction at an erroneous mounting. The user can easily recognize the erroneous mounting. By using the pressure member for urging the developing cartridge to the image carrier for detecting the erroneous mounting, the deformation or damage of the main assembly or the cartridge is suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-187330 filed Aug. 30, 2011, which is hereby incorporated by reference herein in its entirety.

What is claimed is:

1. An electrophotographic image forming apparatus to which a plurality of developing cartridges are detachably mountable, each of the developing cartridges including a developer carrier that develops a latent image formed on an image carrier, a developer container that contains a developer for developing the latent image, and a unique identification portion, the electrophotographic image forming apparatus comprising:

a plurality of mounting portions configured to detachably mount the plurality of the developing cartridges; and a pressure member movably arranged to at least one of the mounting portions, configured to contact the identification portion and urge the developing cartridge in an urging direction to the image carrier when the developing cartridge to be mounted to the mounting portion is inserted into the mounting portion, and to contact the identification portion and urge a developing cartridge with a different function in an opposite direction of a mounting direction to the mounting portion when the developing cartridge with the different function is inserted into the mounting portion, and wherein the pressure member urges the developing cartridge to the image carrier in an inclined direction to the mounting direction.

2. The electrophotographic image forming apparatus according to claim 1, wherein the pressure member includes a roller that contacts the identification portion and a spring that presses the roller.

3. An electrophotographic image forming apparatus to which a plurality of developing cartridges are detachably mountable, each of the developing cartridges including a developer carrier that develops a latent image formed on an image carrier, a developer container that contains a developer for developing the latent image, and a unique identification portion, the electrophotographic image forming apparatus comprising:

a plurality of mounting portions configured to detachably mount the plurality of developing cartridges; and a pressure member movably arranged corresponding to each of the plurality of the mounting portions, configured to contact the identification portion and urge the developing cartridge in an urging direction to the image carrier in a case where a proper developing cartridge is mounted to the mounting portion when mounting the developing cartridge, and to contact the identification portion and urge the developing cartridge in an opposite direction of the mounting direction of mounting the developing cartridge to the mounting portion in a case where an improper developing cartridge is mounted to the mounting portion, and wherein the pressure member urges the developing cartridge to the image carrier in an inclined direction to the mounting direction.

4. The electrophotographic image forming apparatus according to claim 3, wherein after the pressure member contacts the identification portion and urges the developing cartridge in the opposite direction, the pressure member is engaged with a regulation portion provided on the developing cartridge to regulate movement of the developing cartridge in the opposite direction in the case where the improper developing cartridge is mounted to the mounting portion.

5. The electrophotographic image forming apparatus according to claim 3, wherein pressure members respectively arranged corresponding to the plurality of the mounting portions are arranged at different positions in a longitudinal direction of the developing cartridge.

6. The electrophotographic image forming apparatus according to claim 3, wherein the plurality of mounting portions is detachably mounted to the plurality of developing cartridges each containing a developer of a different color.

7. The electrophotographic image forming apparatus according to claim 3, wherein the pressure member includes a roller that contacts the identification portion and a spring that presses the roller.

8. A developing cartridge detachably mountable to a main assembly of an electrophotographic image forming apparatus including a plurality of mounting portions to which the developing cartridge is detachably mounted, and a pressure member that is movably arranged to each of the mounting portions, the developing cartridge comprising:

a developer carrier configured to develop a latent image formed on an image carrier;

a developer container configured to contain a developer for developing the latent image; and an identification portion configured to contact the pressure member and receive urging force in a direction of urging the developing cartridge to the image carrier from the pressure member when the developing cartridge is inserted into the main assembly, and receive urging force in an opposite direction of a mounting direction of mounting the developing cartridge to the mounting portion arranged in an electrophotographic image forming apparatus with a function different from that of the electrophotographic image forming apparatus from a pressure member arranged to the electrophotographic image forming apparatus with the different function when the developing cartridge is mounted to the electrophotographic image forming apparatus with the different function, wherein the identification portion includes a first pressed surface that receives urging force in an urging direction to the image carrier and a second pressed surface that receives urging force in the opposite direction.

9. The developing cartridge according to claim 8, wherein the identification portion is arranged to the developer container.

10. The developing cartridge according to claim 8, further comprising:

a regulation portion configured, after receiving urging force in the opposite direction from the electrophotographic image forming apparatus with the different function, to be engaged with the pressure member to regulate movement of the developing cartridge in the opposite direction.

11. The developing cartridge according to claim 10, wherein the regulation portion is arranged on a downstream side of the second pressed surface in the mounting direction of mounting the developing cartridge to the mounting portion.

12. The developing cartridge according to claim 8, wherein the first pressed surface and the second pressed surface are arranged at different positions in a longitudinal direction of the developer carrier.

13. A developing cartridge detachably mountable to a main assembly of an electrophotographic image forming apparatus including a plurality of mounting portions to which a plurality of the developing cartridges are detachably mounted, and a pressure member that is movably arranged corresponding to each of the plurality of the mounting portions, the developing cartridge comprising:

a developer carrier configured to develop a latent image formed on an image carrier;

a developer container configured to contain a developer for developing the latent image; and an identification portion configured to contact the pressure member when the developing cartridge is inserted into the main assembly, receive urging force in a direction of urging the developing cartridge to the image carrier from the pressure member in a case of mounting the developing cartridge to a correct mounting portion, and receive urging force in an opposite direction of a mounting direction of mounting the developing cartridge to the mounting portion from the pressure member in a case of mounting the developing cartridge to an incorrect mounting portion, wherein the identification portion includes a first pressed surface that receives urging force from the pressure member when mounting the developing cartridge to the correct mounting portion, and a second pressed surface that receives urging force from the pressure member when the developing cartridge is mounted to the incorrect mounting portion.

14. The developing cartridge according to claim 13, wherein the identification portion is arranged to the developer container.

15. The developing cartridge according to claim 13, further comprising:

a regulation portion configured to regulate movement of the developing cartridge in the opposite direction by engagement with the pressure member after the pressure member contacts the identification portion and the developing cartridge is urged in the opposite direction when the developing cartridge is inserted into the incorrect mounting portion.

16. The developing cartridge according to claim 15, wherein the regulation portion is arranged on a downstream side of the second pressed surface in the mounting direction of mounting the developing cartridge to the mounting portion.

17. The developing cartridge according to claim 13, wherein the first pressed surface and the second pressed surface are arranged at different positions in a longitudinal direction of the developer carrier.

* * * * *